US010479098B2

(12) United States Patent
Shirono et al.

(10) Patent No.: US 10,479,098 B2
(45) **Date of Patent: *Nov. 19, 2019**

(54) TANK AND LIQUID CONSUMING APPARATUS INCLUDING THE SAME

(71) Applicant: BROTHER KOGYO KABUSHIKI KAISHA, Nagoya-shi, Aichi-ken (JP)

(72) Inventors: Taichi Shirono, Nagoya (JP); Masahiro Hayashi, Nagoya (JP); Masako Kawagoe, Nagoya (JP); Yoshinori Osakabe, Seto (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/146,665

(22) Filed: Sep. 28, 2018

(65) Prior Publication Data

US 2019/0030905 A1 Jan. 31, 2019

Related U.S. Application Data

(63) Continuation of application No. 15/473,831, filed on Mar. 30, 2017, now Pat. No. 10,086,619.

(30) Foreign Application Priority Data

Mar. 31, 2016 (JP) ..... 2016-073592

(51) Int. Cl.
*B41J 2/17* (2006.01)
*B41J 2/175* (2006.01)
(Continued)

(52) U.S. Cl.
CPC ..... *B41J 2/17523* (2013.01); *B41J 2/1753* (2013.01); *B41J 2/17509* (2013.01);
(Continued)

(58) Field of Classification Search
None
See application file for complete search history.

(56) References Cited

U.S. PATENT DOCUMENTS 7,954,933 B2 6/2011 Fung et al.
2011/0069126 A1* 3/2011 Feng ..... B41J 2/17513 347/87
2012/0056938 A1 3/2012 Ishizawa et al.

FOREIGN PATENT DOCUMENTS

CN 1569466 A 1/2005
JP 2012-51306 A 3/2012

OTHER PUBLICATIONS

Office Action issued in related Chinese Patent Application No. 201710187586.0, dated Aug. 21, 2019.

* cited by examiner

*Primary Examiner* — Erica S Lin
(74) *Attorney, Agent, or Firm* — Merchant & Gould P.C.

(57) ABSTRACT

A tank is installed in a liquid consuming apparatus having a liquid consuming unit and is connected to the liquid consuming unit. The tank includes: a casing having a bottom wall and a side wall in a usable posture of the tank, the side wall extending in a direction intersecting the bottom wall; a first storage chamber and a second storage chamber provided in the casing and configured to store the liquid; an inlet provided to inject the liquid into the first storage chamber; a first communication port that communicates the first storage chamber and the second storage chamber; a second communication port provided in the second storage chamber to let the liquid flow out to an outside of the tank; and an air opening port that opens the first storage chamber and the second storage chamber to the air.

5 Claims, 11 Drawing Sheets

(51) Int. Cl.
*B41J 29/02* (2006.01)
*B41J 29/13* (2006.01)

(52) U.S. Cl.
CPC ..... *B41J 2/17513* (2013.01); *B41J 2/17553* (2013.01); *B41J 2/17566* (2013.01); *B41J 29/02* (2013.01); *B41J 29/13* (2013.01); *B41J 2002/17573* (2013.01)

TANK AND LIQUID CONSUMING APPARATUS INCLUDING THE SAME

CROSS REFERENCE TO RELATED APPLICATION

The application is a Continuation of U.S. patent application Ser. No. 15/473,831, filed on Mar. 30, 2017, which claims priority from Japanese Patent Application No. 2016-073592, filed on Mar. 31, 2016, the disclosures of which are incorporated herein by reference in their entireties.

BACKGROUND

Field of the Invention

The present invention relates to a tank that can be replenished with liquid via an inlet and a liquid consuming apparatus including the tank.

Description of the Related Art

There is known a printer that includes: a tank that can be replenished with ink; and a recording head that records an image on a sheet by discharging, from a nozzle, the ink supplied from said tank. When the ink in the tank is consumed, a user can replenish the tank, via an inlet of the tank, with ink stored in a bottle.

SUMMARY

In order to, for example, suppress foaming or stabilize a liquid surface in the previously mentioned tank, it is conceivable for a storage chamber in the tank to be divided into a plurality of storage chambers. However, when ink stored in the tank flows out in large quantity in a short time toward the recording head in the case of recording an image where consumption amount of ink is comparatively large as in photograph printing, for example, or in the case that a large amount of ink is sucked up from the recording head in maintenance, first, ink flows out from a storage chamber disposed immediately upstream of an ink outflow port of the tank. Then, ink flows into this storage chamber from a storage chamber further upstream. If the two storage chambers are both opened to the air, eventually, heights of liquid surfaces of ink in the two storage chambers become equal.

However, sometimes, if a flow path resistance (pressure loss) when ink flows between the two storage chambers is large, then an amount of ink that flows out to the recording head from the storage chamber immediately upstream of the outflow port becomes larger, per unit time, than an amount of ink flowing into the storage chamber immediately upstream of the outflow port from the storage chamber further upstream. In this case, ink is consumed resulting in the liquid surface falling in the storage chamber immediately upstream of the outflow port, regardless of ink being sufficiently stored in the storage chamber further upstream. As a result, there is a risk of a gas getting mixed in to a tube connecting the tank and the recording head, or of that gas reaching the recording head to cause a discharge failure.

The present teaching was made in view of the previously mentioned circumstances, and has an object of providing a means whereby, in a tank having two storage chambers, outflow speeds of liquid in the two storage chambers easily become uniform.

According to an aspect of the present teaching, there is provided a tank configured to be installed in a liquid consuming apparatus having a liquid consuming unit and be connected to the liquid consuming unit such that liquid flows between the tank and the liquid consuming unit, the tank including: a casing having a bottom wall and a side wall in a usable posture of the tank, the side wall extending in a direction intersecting the bottom wall; a first storage chamber and a second storage chamber provided in the casing and configured to store the liquid; an inlet provided to inject the liquid into the first storage chamber; a first communication port that communicates the first storage chamber and the second storage chamber; a second communication port provided in the second storage chamber to let the liquid flow out to an outside of the tank; and an air opening port that opens the first storage chamber and the second storage chamber to the air, wherein the second storage chamber includes: a first space extending along the bottom wall from the second communication port; and a second space connected to the first space in a vicinity of the second communication port and extending along the side wall from the second communication port, and in a state that at least a minimum storage amount of the liquid is stored in the first storage chamber and the second storage chamber, a first pressure loss when the liquid stored in the second storage chamber flows from the first communication port to the second communication port via the first space is equal to a second pressure loss when the liquid stored in the second storage chamber flows to the second communication port along the second space.

As liquid is consumed in a liquid consuming unit, liquid flows out to the liquid consuming unit from a tank via a second communication port. When liquid of an amount at a time that replenishment of liquid becomes required in the tank, is stored in a first storage chamber and a second storage chamber, a first pressure loss and a second pressure loss are equal. Therefore, at least when liquid of more than said amount is stored in the tank, in the second storage chamber, flow speed of liquid in a second space and flow speed of liquid from the first storage chamber to the second communication port become equal, and outflow speed of liquid in the first storage chamber and outflow speed of liquid in the second storage chamber become equal.

Due to the tank according to the aspect of the present teaching, in a tank having two storage chambers, outflow speeds of liquid in the two storage chambers easily become uniform.

DESCRIPTION OF THE EMBODIMENTS

Figure 1A:
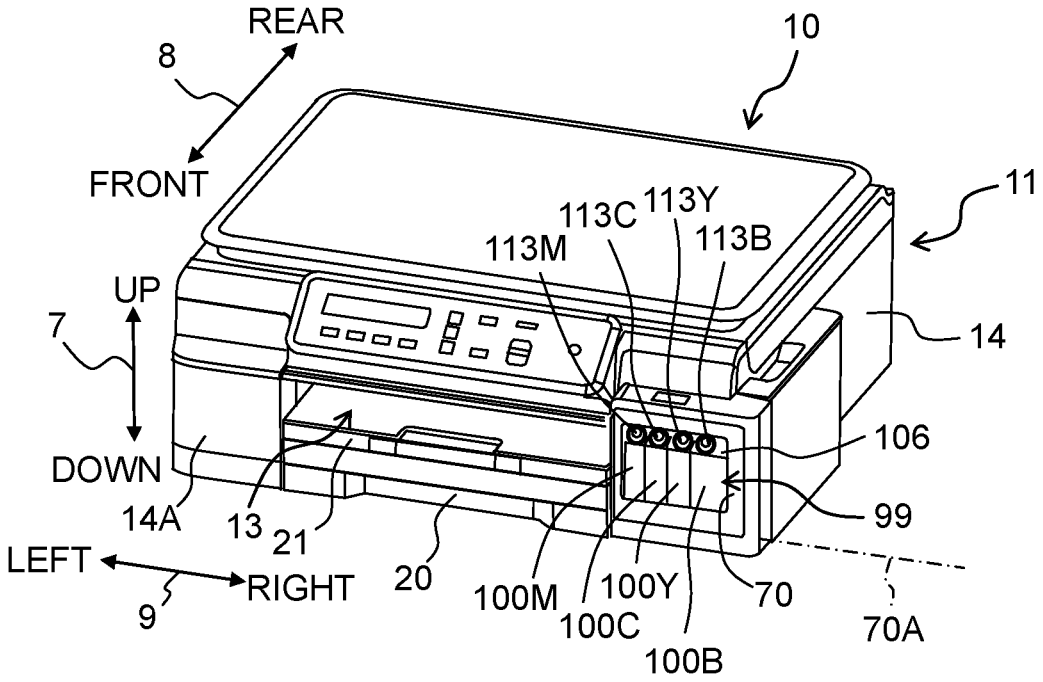
FIG. 1A is a perspective view of external appearance of a multifunction peripheral in a state where a cover is in a closed position.

An embodiment of the present teaching will be described below. Note that the embodiment described below is merely an example of the present teaching, and it goes without saying that the embodiment of the present teaching may be appropriately changed in a range that does not alter the gist or essential characteristics of the present teaching. In the description below, a posture (the posture of FIGS. 1A and 1B) where a multifunction peripheral 10 and an ink tank 100 installed in the multifunction peripheral 10 are usably disposed in a horizontal plane will be described as a "usable posture". An up-down direction 7 is defined with reference to the usable posture. A front-rear direction 8 is defined assuming a surface provided with an opening 13 of the multifunction peripheral 10 to be a front surface. A left-right direction 9 is defined viewing the multifunction peripheral 10 from the front surface. In the present embodiment, in the usable posture, the up-down direction 7 corresponds to a vertical direction, and the front-rear direction 8 and the left-right direction 9 correspond to horizontal directions. Note that an upward orientation is a component of the up-down direction 7, and a downward orientation is also a component of the up-down direction 7. Similarly, a leftward orientation and a rightward orientation are each components of the left-right direction 9. A frontward orientation and a rearward orientation are each components of the front-rear direction 8.

<Overall Structure of Multifunction Peripheral 10>

Figure 1B:
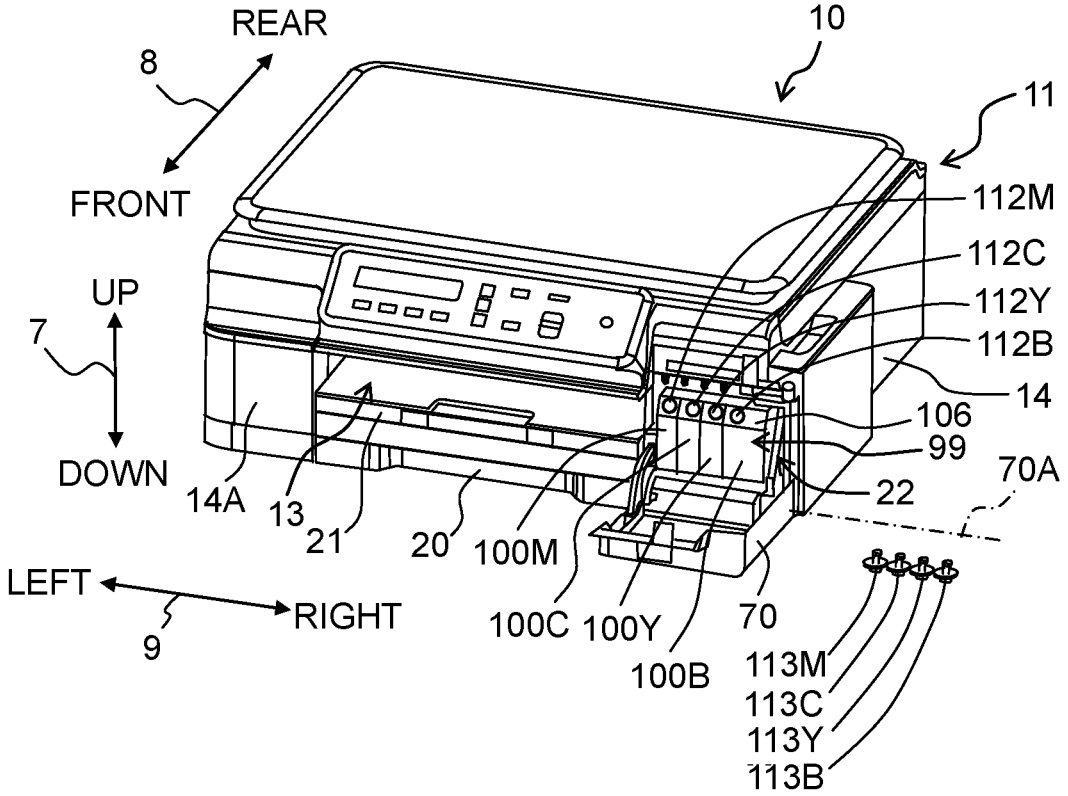
FIG. 1B is a perspective view of external appearance of the multifunction peripheral in a state where the cover is in an open position.
Figure 2:
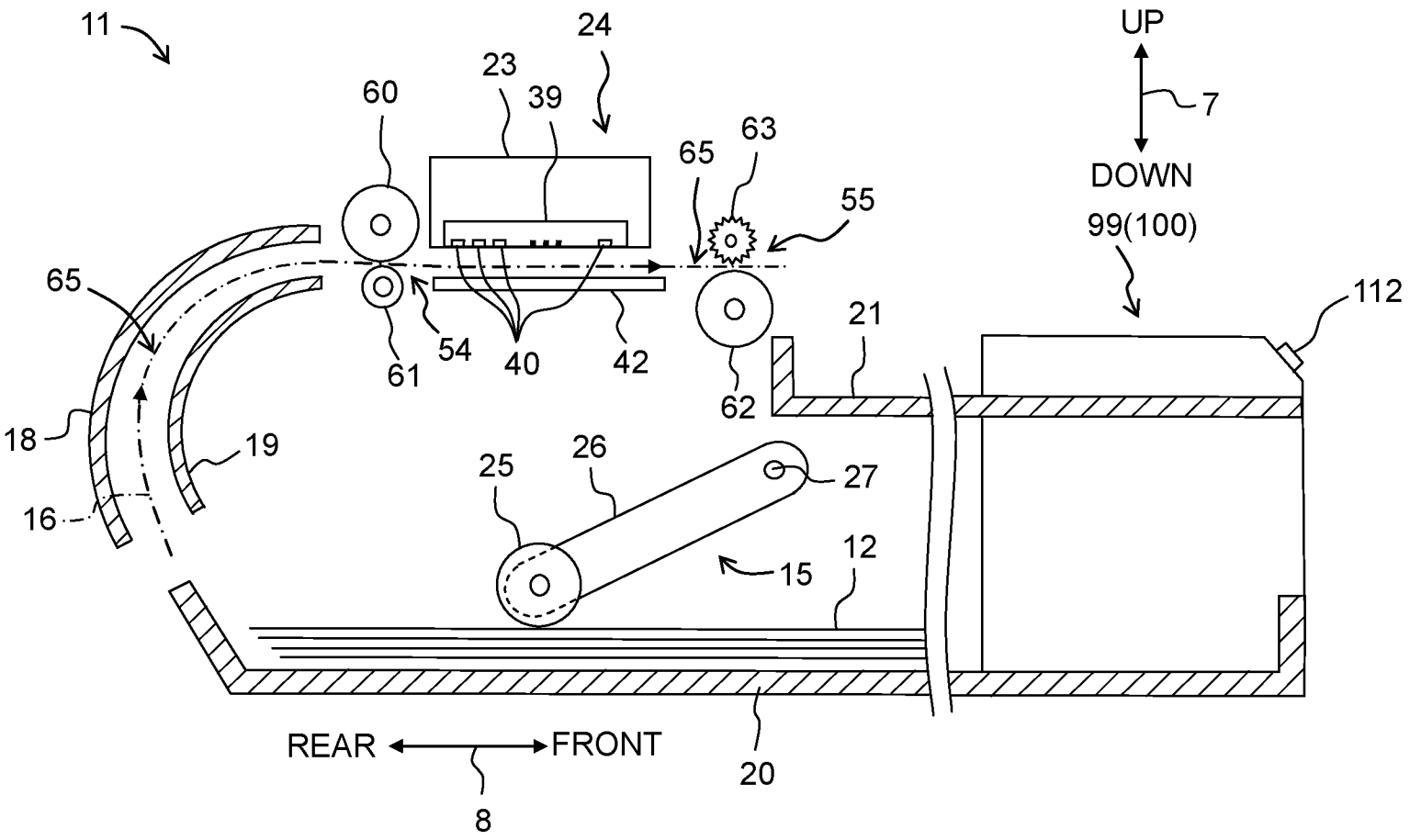
FIG. 2 is a longitudinal cross-sectional view depicting schematically an internal structure of a printer unit.

As depicted in FIGS. 1A and 1B, the multifunction peripheral 10 has roughly a rectangular parallelepiped shape. A printer unit 11 that records an image on a sheet 12 (refer to FIG. 2) by an ink-jet recording system, is provided in a lower section of the multifunction peripheral 10. The printer unit 11 has a casing 14. The opening 13 is formed in a front wall 14A of the casing 14. As depicted in FIG. 2, the following are disposed on the inside of the casing 14, namely, a feed unit 15, a feed tray 20, a discharge tray 21, a conveyance roller unit 54, a recording unit 24, a discharge roller unit 55, a platen 42, and a tank set 99. The multifunction peripheral 10 has various functions such as a facsimile function and a print function. The multifunction peripheral 10 is an example of a liquid consuming apparatus having a liquid consuming unit.

<Feed Tray 20, Discharge Tray 21>

The opening 13 is formed in the front surface and in a central section in the left-right direction 9 of the multifunction peripheral 10. As depicted in FIGS. 1A and 1B, the feed tray 20 is inserted/removed in the front-rear direction 8 into/from the multifunction peripheral 10, via the opening 13, by a user. The feed tray 20 can support a stacked plurality of the sheets 12. The discharge tray 21 is disposed upwardly of the feed tray 20 and is inserted/removed along with the feed tray 20. The discharge tray 21 supports the sheet 12 that has been discharged from between the recording unit 24 and the platen 42 by the discharge roller unit 55.

<Feed Unit 15>

The feed unit 15 feeds to a conveyance passage 65 the sheet 12 supported by the feed tray 20. As depicted in FIG. 2, the feed unit 15 includes a feed roller 25, a feed arm 26, and a shaft 27. The feed roller 25 is rotatably supported by a distal end of the feed arm 26. Reverse rotation of a conveyance motor (not illustrated) results in the feed roller 25 rotating in an orientation by which the sheet 12 is conveyed in a conveyance orientation 16. Hereafter, the feed roller 25, a conveyance roller 60, and a discharge roller 62 rotating in an orientation by which the sheet 12 is conveyed in the conveyance orientation 16 will be described as "forward rotation". The feed arm 26 is pivotably supported by the shaft 27 which is supported by a frame of the printer unit 11. The feed arm 26 is biased so as to pivot to a feed tray 20 side by an elastic force due to the likes of its own weight or a spring.

<Conveyance Passage 65>

Figure 3:
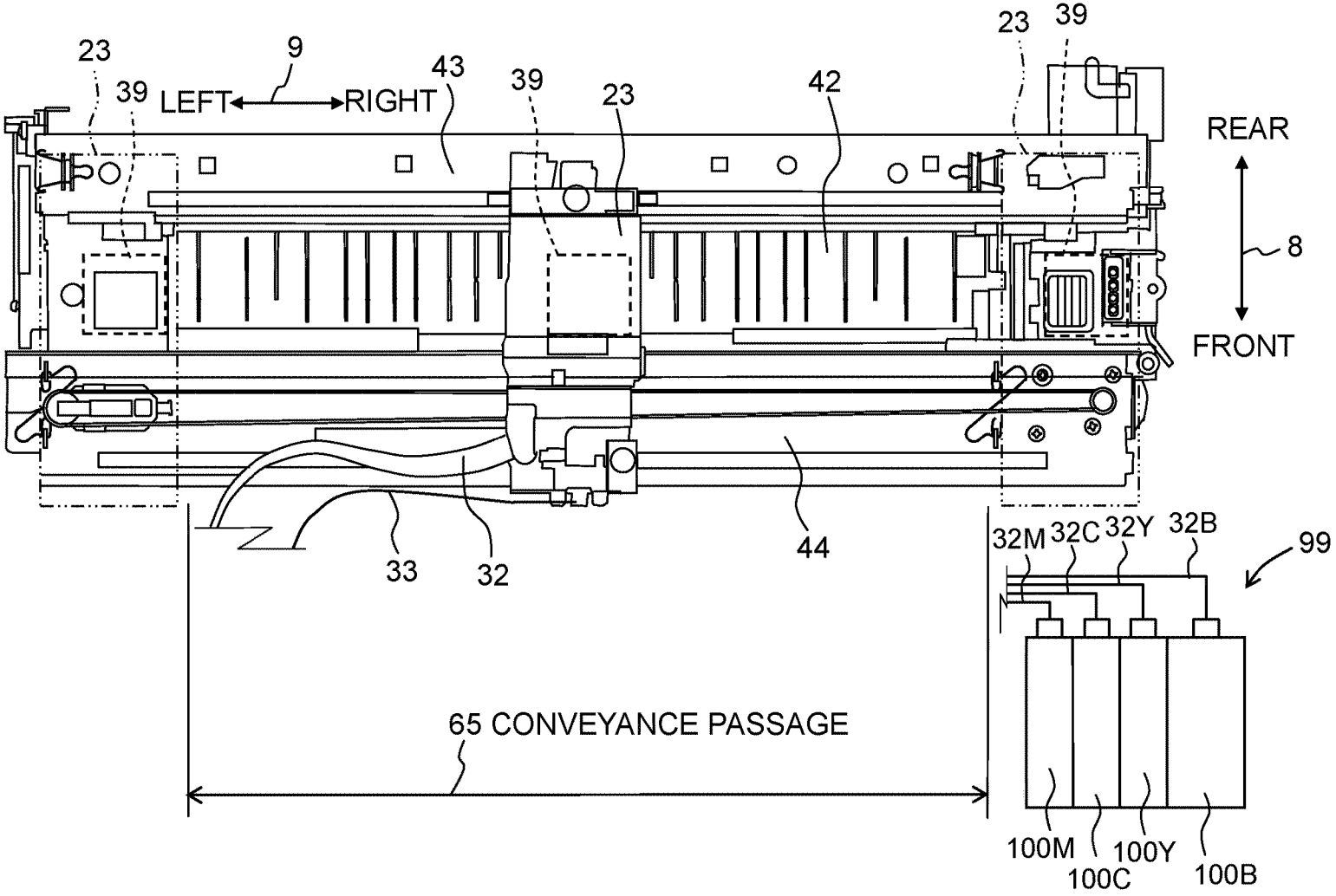
FIG. 3 is a plan view depicting an arrangement of a carriage and a tank set.

As depicted in FIG. 2, the conveyance passage 65 is a path that extends to a rear of the printer unit 11 from a rear end section of the feed tray 20, makes a U-turn frontwards while extending upwardly at the rear of the printer unit 11, and passes along a space between the recording unit 24 and the platen 42 to reach the discharge tray 21. Part of the conveyance passage 65 is a space formed by an outer guide member 18 and an inner guide member 19 that face each other with a certain spacing between them on the inside of the printer unit 11. As depicted in FIGS. 2 and 3, a portion between the conveyance roller unit 54 and the discharge roller unit 55, of the conveyance passage 65 is provided in roughly the central section in the left-right direction 9 of the multifunction peripheral 10, and extends in the front-rear direction 8. The conveyance orientation 16 of the sheet 12 in the conveyance passage 65 is indicated by a dot-chain line arrow in FIG. 2.

<Conveyance Roller Unit 54>

As depicted in FIG. 2, the conveyance roller unit 54 is disposed upstream in the conveyance orientation 16 of the recording unit 24. The conveyance roller unit 54 includes the conveyance roller 60 and a pinch roller 61 that face each other. The conveyance roller 60 is driven by the conveyance motor. The pinch roller 61 rotates in company with rotation of the conveyance roller 60. The sheet 12 is nipped by the conveyance roller 60 that forwardly rotates by forward rotation of the conveyance motor, and the pinch roller 61, whereby the sheet 12 is conveyed in the conveyance orientation 16.

<Discharge Roller Unit 55>

As depicted in FIG. 2, the discharge roller unit 55 is disposed downstream in the conveyance orientation 16 of the recording unit 24. The discharge roller unit 55 includes the discharge roller 62 and a spur wheel 63 that face each other. The discharge roller 62 is driven by the conveyance motor. The spur wheel 63 rotates in company with rotation of the discharge roller 62. The sheet 12 is nipped by the discharge roller 62 that forwardly rotates by forward rotation of the conveyance motor, and the spur wheel 63, whereby the sheet 12 is conveyed in the conveyance orientation 16.

<Recording Unit 24>

As depicted in FIG. 2, the recording unit 24 is disposed between the conveyance roller unit 54 and the discharge roller unit 55 in the conveyance orientation 16. The recording unit 24 is disposed so as to face the platen 42 in the up-down direction 7, sandwiching the conveyance passage 65 between itself and the platen 42. The recording unit 24 includes a carriage 23 and a recording head 39 (an example of a liquid consuming unit).

As depicted in FIG. 3, the carriage 23 is supported by guide rails 43, 44 that are provided extending in the left-right direction 9, separated in the front-rear direction 8. The guide rails 43, 44 are supported by the frame of the printer unit 11. The carriage 23 is coupled to a publicly known belt mechanism provided in the guide rail 44. The belt mechanism is driven by a carriage motor (not illustrated). The carriage 23 coupled to the belt mechanism makes a reciprocating movement along the left-right direction 9 by drive of the carriage motor. A range of movement of the carriage 23 reaches to rightward and leftward of the conveyance passage 65, as depicted by the dot-chain lines of FIG. 3.

An ink tube 32 and a flexible flat cable 33 are extended out from the carriage 23.

The ink tube 32 connects the tank set 99 and the recording head 39. The ink tube 32 provides the recording head 39 with ink stored in four ink tanks 100B, 100Y, 100C, 100M (these are sometimes indicated collectively as "ink tank 100") that configure the tank set 99. In detail, four ink tubes 32B, 32Y, 32C, 32M in which black, yellow, cyan, magenta inks flow are respectively extended out from the ink tanks 100B, 100Y, 100C, 100M, and connected to the carriage 23 in a state where these ink tubes 32B, 32Y, 32C, 32M have been bundled. The four ink tubes 32B, 32Y, 32C, 32M are sometimes described collectively as "ink tube 32".

The flexible flat cable 33 electrically connects a control board on which a control unit (not illustrated) is mounted and the recording head 39. The flexible flat cable 33 transmits to the recording head 39 a control signal outputted from the control unit.

As depicted in FIG. 2, the recording head 39 is mounted in the carriage 23. A plurality of nozzles 40 is disposed in a lower surface of the recording head 39. Tips of the plurality of nozzles 40 are exposed from the lower surface of the recording head 39. Hereafter, a surface from which the tip of the nozzle 40 is exposed will be described as a "nozzle surface". The recording head 39 discharges ink from the nozzle 40 as a minute ink droplet. In a process of the carriage 23 moving, the recording head 39 discharges the ink droplet toward the sheet 12 supported by the platen 42. As a result, an image is recorded on the sheet 12. Moreover, as a result, ink stored in the ink tank 100 is consumed.

The printer unit 11 includes a maintenance mechanism (not illustrated). The maintenance mechanism performs maintenance of the recording head 39. In detail, the maintenance mechanism executes a purge operation that sucks up ink or air in the nozzle 40 or a removal operation that removes foreign matter, and so on, adhered to the nozzle surface. The maintenance mechanism sends forth ink sucked up from the nozzle 40 of the recording head 39 to a waste ink tank (not illustrated), via a tube (not illustrated). The maintenance mechanism is disposed directly below the carriage 23 positioned more rightward or leftward than the conveyance passage 65.

Before the purge operation is executed, the carriage 23 moves to directly above the maintenance mechanism. Then, a cap (not illustrated) of the maintenance mechanism moves upwardly to cover the nozzle surface. The cap is connected to the waste ink tank via the tube. A rotary-type tube pump is disposed in the tube. Driving of the tube pump causes inside the tube to become a vacuum. As a result, ink in the recording head 39 is sucked up. The sucked up ink is discharged to the waste ink tank via the cap and the tube.

Note that the tube is in a state of being blocked by the rotary-type tube pump in at least one place.

<Platen 42>

As depicted in FIGS. 2 and 3, the platen 42 is disposed between the conveyance roller unit 54 and the discharge roller unit 55, in relation to the conveyance orientation 16. The platen 42 is disposed so as to face the recording unit 24 in the up-down direction 7, sandwiching the conveyance passage 65 between itself and the recording unit 24. The platen 42 supports, from below, the sheet 12 conveyed by the conveyance roller unit 54.

<Tank Set 99>

The tank set 99 stores the ink supplied to the recording head 39. As depicted in FIGS. 1A and 1B, the tank set 99 includes the four ink tanks 100B, 100Y, 100C, 100M. A different color of ink is respectively stored in each of the four ink tanks 100B, 100Y, 100C, 100M. Specifically, black ink is stored in the ink tank 100B, yellow ink is stored in the ink tank 100Y, cyan ink is stored in the ink tank 100C, and magenta ink is stored in the ink tank 100M. However, the number of ink tanks 100 and colors of the inks are not limited to the above-described example.

The four ink tanks 100B, 100Y, 100C, 100M are disposed in line along the left-right direction 9. Of the four ink tanks 100B, 100Y, 100C, 100M, the ink tank 100B is disposed most rightwards, and the ink tank 100M is disposed most leftwards. Note that arrangement positions of the ink tanks 100 are not limited to the above-described example. The black ink-dedicated ink tank 100B has a size, particularly a width in the left-right direction 9 which is larger than those of the color ink-dedicated ink tanks 100Y, 100C, 100M. Note that a magnitude relationship of sizes of the ink tanks 100 is not limited to the above-described example. The ink tank 100B has a permissible storage amount of ink which is larger than those of the other ink tanks 100Y, 100C, 100M. Note that a magnitude relationship of permissible storage amounts of the ink tanks 100 is not limited to the above-described example.

As depicted in FIGS. 1A and 1B, the tank set 99 is installed in a right front section on the inside of the casing 14. In other words, the tank set 99 is fixed to the multifunction peripheral 10 such that it cannot be easily removed from the multifunction peripheral 10. Note that "cannot be easily removed" means, for example, that the user cannot easily remove the tank set 99 from the casing 14 of the multifunction peripheral 10 in a state of ordinary use, and excludes cases such as when a skilled repairer removes the tank set 99 from the casing 14 of the multifunction peripheral 10 for repair. Therefore, the user should not be able to easily remove the tank set 99 from the casing 14 of the multifunction peripheral 10 in a state of ordinary use.

A front surface of each of the ink tanks 100 is exposed to the outside of the multifunction peripheral 10 via an opening 22 formed in a right section of the front wall 14A of the casing 14. The opening 22 is adjacent in the left-right direction 9 to the opening 13. The casing 14 is provided with a cover 70. The cover 70 is pivotable between a closed position where the opening 22 is covered (position depicted in FIG. 1A) and an open position where the opening 22 is exposed (position depicted in FIG. 1B). The cover 70 has an unillustrated pivot shaft extending in the left-right direction 9 in a vicinity of a lower end in the up-down direction 7 of the cover 70, and is supported by the casing 14 so as to pivot around a pivotal axis 70A of the pivot shaft.

Configurations of the ink tanks 100 will be described in detail below. Since configurations of the color ink-dedicated ink tanks 100Y, 100C, 100M are the same, hereafter, one of the ink tanks 100Y, 100C, 100M will be referred to as the ink tank 100 and its configuration will be described. Moreover, a configuration of the black ink-dedicated ink tank 100B is similar to the configuration of the ink tanks 100Y, 100C, 100M, hence after the configuration of the ink tanks 100Y, 100C, 100M has been described, the configuration of the ink tank 100B will be described for portions different from in the ink tanks 100Y, 100C, 100M. In this case, configurations having a similar function even though shapes somewhat differ in the configurations of the ink tank 100B and the ink tanks 100Y, 100C, 100M, will be assigned with identical reference symbols. Note that in the description below, unless specifically stated otherwise, the multifunction peripheral 10 and the ink tank 100 installed in the multifunction peripheral 10 are in the usable posture.

<Ink Tank 100>

Figure 4:
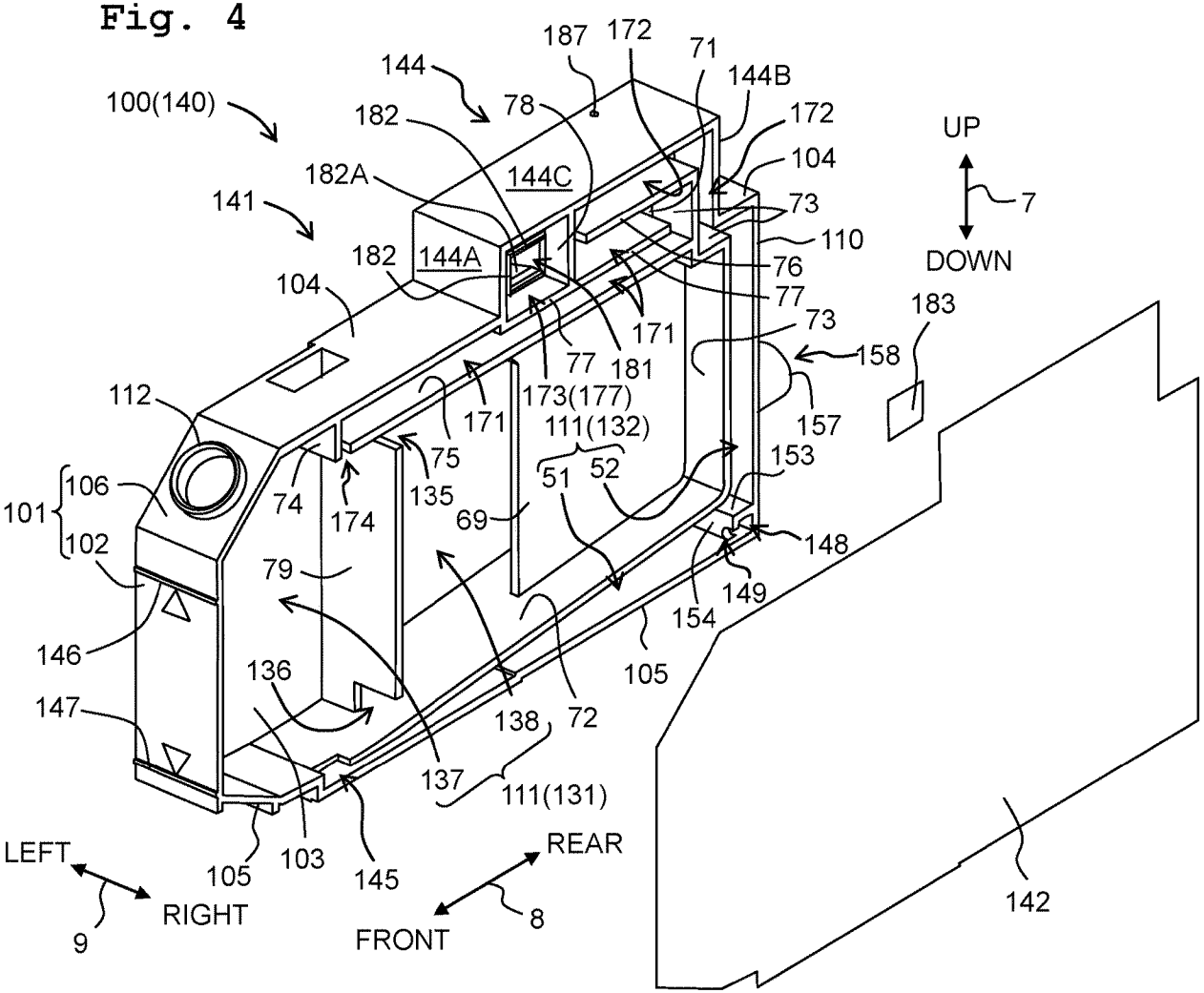
FIG. 4 is a front perspective view of an ink tank for a color ink.
Figure 5:
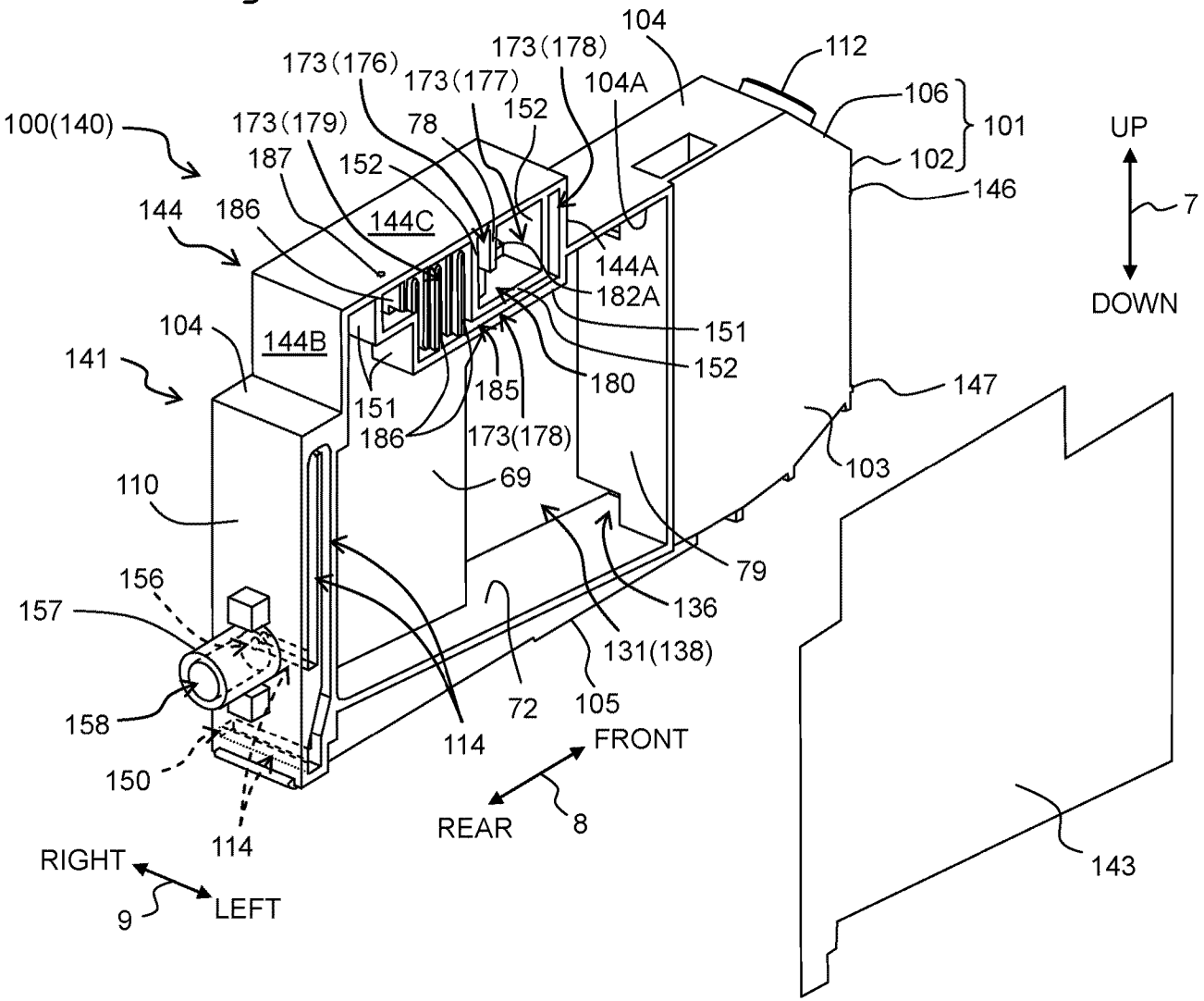
FIG. 5 is a rear perspective view of the ink tank for the color ink.

As depicted in FIGS. 4 and 5, the ink tank 100 is configured by a casing 140 forming an outer shape of the ink tank. The casing 140 includes a frame 141 and two films 142, 143.

The frame 141 has a flat rectangular parallelepiped shape in which a dimension in the left-right direction 9 is short and dimensions in the up-down direction 7 and the front-rear direction 8 are longer than the dimension in the left-right direction 9. Moreover, the dimension in the front-rear direction 8 is longer than the dimension in the up-down direction 7. In other words, the ink tank 100 has a first side along the front-rear direction 8, a second side along the up-down direction 7 which is shorter than said first side, and a third side along the left-right direction 9 which is shorter than said second side.

The frame 141 is formed by a resin having sufficient translucency to enable a liquid surface of ink in a later-mentioned ink chamber 111 to be visually confirmed from the outside of the ink tank 100. The frame 141 is formed by, for example, polypropylene. The frame 141 is integrally molded by, for example, injection molding a resin material. Rigidity of the frame 141 is higher than rigidity of the films 142, 143.

Note that the frame 141 may be configured by a material other than a resin. Moreover, the frame 141 may have a configuration in which a plurality of members is combined. For example, it is possible for a later-mentioned first ink chamber 131 and second ink chamber 132 to be respectively configured by two separate casings, and for these two casings to be joined by a tube, or the like.

The frame 141 includes a front wall 101, a left wall 103 (an example of a side wall), an upper wall 104, a lower wall 105 (an example of a bottom wall), a rear wall 110, and inner walls 69, 71-79, 151-155.

The front wall 101 is configured by an upright wall 102 and an inclined wall 106. The upright wall 102 extends in the up-down direction 7 and the left-right direction 9. The inclined wall 106 is a wall joining an upper end of the upright wall 102 and a front end of the upper wall 104, and inclines in the up-down direction 7 and the front-rear direction 8.

The left wall 103 is a wall extending rearwards from a left end of the front wall 101. An upper end of the left wall 103 is connected to a front section of the upper wall 104. A lower end of the left wall 103 is connected to a front section of the lower wall 105. In other words, the left wall 103 is a wall joining the left end of the front wall 101, a left end of the front section of the upper wall 104, and a left end of the front section of the lower wall 105. In other words, the left wall 103 is provided only in a front section of the frame 141 and is not provided in a rear section of the frame 141.

The upper wall 104 extends rearwards from an upper end of the front wall 101 (rear end of the inclined wall 106). The front section of the upper wall 104 is connected to the upper end of the left wall 103. A protrusion 144 protruding upwardly is formed roughly from a central section to a rear section in the front-rear direction 8 of the upper wall 104. The protrusion 144 includes: a front wall 144A protruding upwardly from roughly the central section in the front-rear direction 8 of the upper wall 104; a rear wall 144B protruding upwardly from the rear section of the upper wall 104; and an upper wall 144C joining an upper end of the front wall 144A and an upper end of the rear wall 144B.

The lower wall 105 is a wall extending rearwards from a lower end of the front wall 101. The lower wall 105 is formed separated downwardly from the upper wall 104. As mentioned above, the front section of the lower wall 105 is connected to the lower end of the left wall 103. A left end section of the lower wall 105 is bent upwardly. An upper end of the bent lower wall 105 is connected to a lower surface of the later-mentioned inner wall 72 (refer to FIG. 5).

The rear wall 110 is formed separated rearwards from the front wall 101. As mentioned above, the upper end of the rear wall 110 is connected to the rear end of the upper wall 104. The lower end of the rear wall 110 is connected to the rear end of the lower wall 105. A left section of the rear wall 110 is positioned more rearwards than a right section of the rear wall 110. A later-mentioned ink outflow passage 114 is formed in the left section of the rear wall 110.

Figure 6:
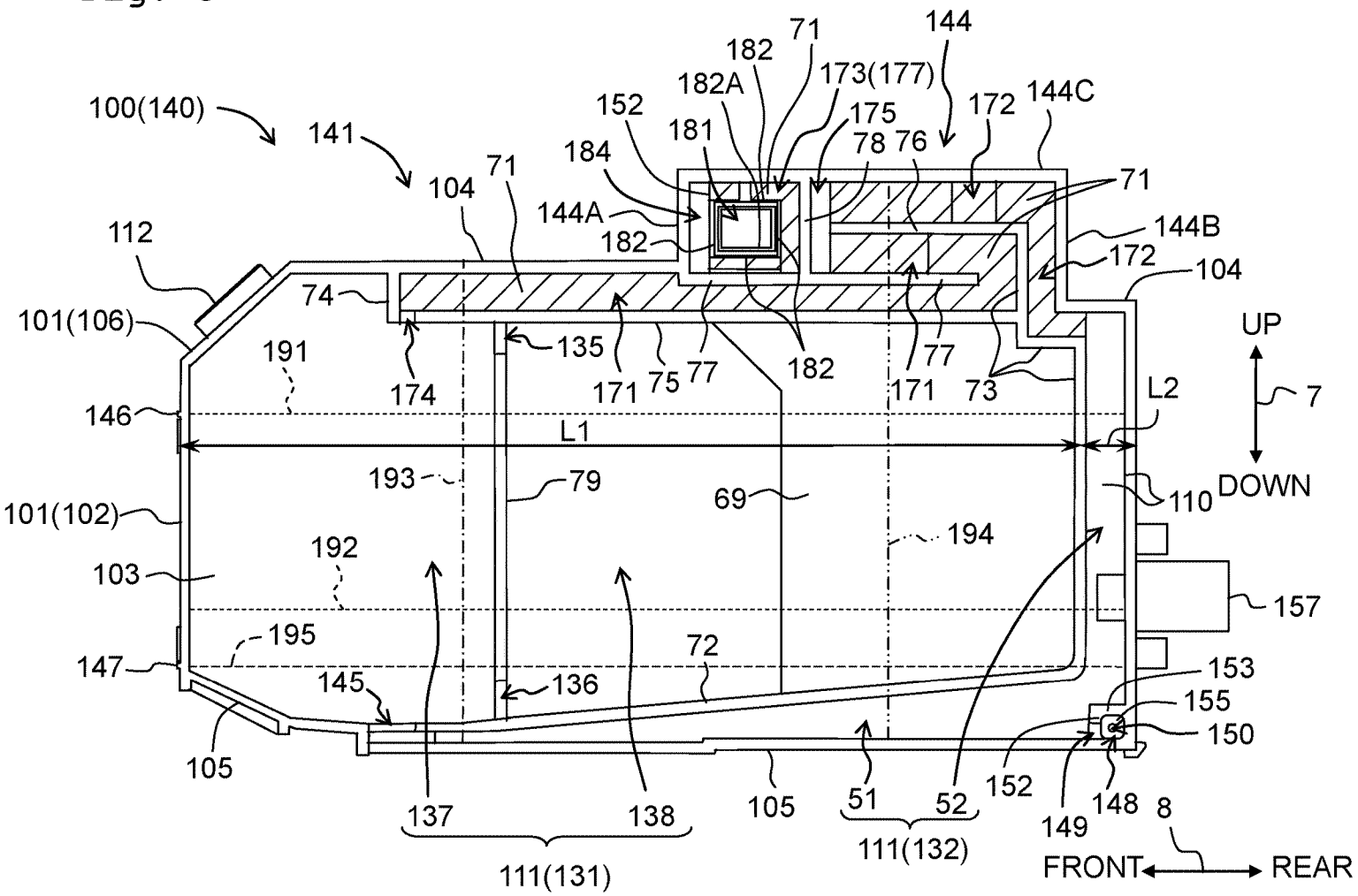
FIG. 6 is a right side view of the ink tank for the color ink.
Figure 7:
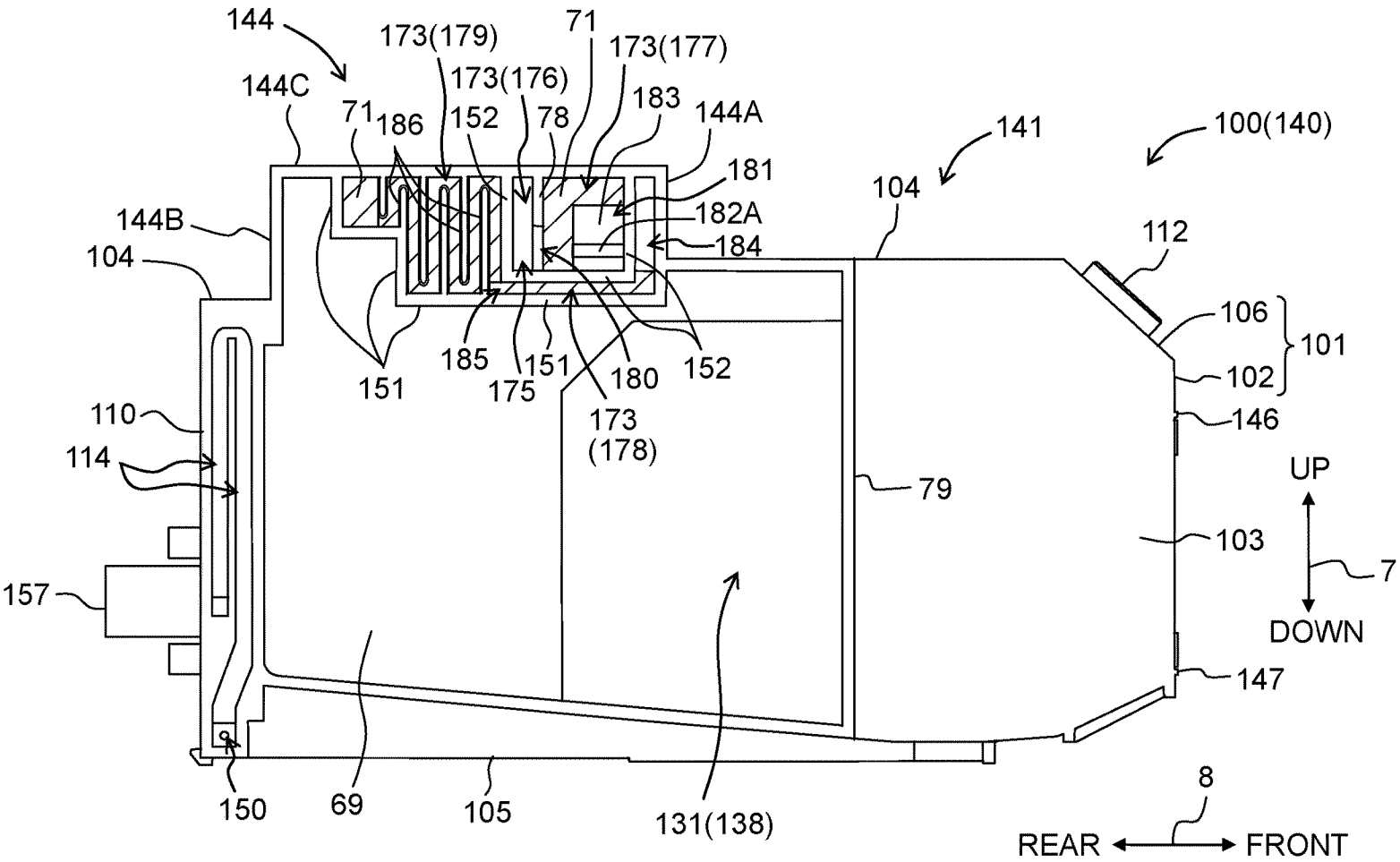
FIG. 7 is a left side view of the ink tank for the color ink.

As depicted in FIGS. 6 and 7, the inner wall 71 extends downwardly from the upper wall 104 and the upper wall 144C of the protrusion 144. The inner wall 71 is a wall extending in the up-down direction 7 and the front-rear direction 8. The inner wall 71 is provided in a range of hatching depicted in FIGS. 6 and 7. The inner wall 71 is provided at any position between a right end and a left end of the frame 141, in relation to the left-right direction 9. For example, the inner wall 71 is provided roughly in a central section of the frame 141, in relation to the left-right direction 9. As a result, the inside of the frame 141 is divided into left and right at a place where the inner wall 71 is provided. Moreover, the inner wall 71 may be provided at a position close to the right end of the frame 141 or a position close to the left end of the frame 141, in relation to the left-right direction 9. Note that the inner wall 71 defines part of a later-mentioned communicating path, hence is desirably provided at a position not including the right end and the left end of the frame 141.

As depicted in FIGS. 4 and 5, the inner wall 72 is provided in a vicinity of the lower wall 105 between the upper wall 104 and the lower wall 105, in relation to the up-down direction 7. The inner wall 72 extends rearwards while inclining upwardly, from the front end section to the rear end section of the lower wall 105. A front end of the inner wall 72 is connected to a part on a front end section side of the lower wall 105. A rear end of the inner wall 72 is positioned separated from the rear wall 110, frontwards of the rear wall 110.

The inner wall 73 extends roughly upwardly from the rear end of the inner wall 72, while maintaining constant a spacing from the rear wall 110. The inner wall 73 extends to the inside of the protrusion 144 while bending so as to follow an outer shape of the protrusion 144. An upper end of the inner wall 73 is positioned separated from the upper wall 144C of the protrusion 144, downwardly of the upper wall 144C. Part of the inner wall 73 (a portion more downward than the later-mentioned inner wall 75) extends from the right end to the left end of the frame 141. On the other hand, another portion of the inner wall 73 extends from the right end of the frame 141 to the inner wall 71.

The inner wall 69 extends in the up-down direction 7 and the front-rear direction 8. The inner wall 69 is positioned between the inner wall 72 and the later-mentioned inner wall 75 in relation to the up-down direction 7. The inner wall 69 is positioned frontwards of the inner wall 73. The inner wall 69 is provided roughly in the central section of the frame 141 in relation to the left-right direction 9. As a result, a later-mentioned rear ink chamber 138 of the first ink chamber 131 is divided into left and right at a place where the inner wall 69 is provided. A lower end of the inner wall 69 is connected to a rear section of the inner wall 72. An upper end of the inner wall 69 is connected to a rear section of the inner wall 75. A rear end of the inner wall 69 is connected to the inner wall 73.

The inner walls 74-77 described below extend rightwards from the inner wall 71 (refer to FIG. 6). In other words, the inner walls 74-77 extend from the inner wall 71 to the right end of the frame 141.

As depicted in FIGS. 4 to 6, the inner wall 74 extends downwardly in a front section of a lower surface 104A of the upper wall 104. A left end of the inner wall 74 is connected to the left wall 103, and a rear surface of the inner wall 74 is connected to a front end of the inner wall 71.

The inner wall 75 extends rearwards from a lower end of the inner wall 74. A rear end of the inner wall 75 is connected to the inner wall 73.

The inner wall 76 extends frontwards from an upper end of the inner wall 73. In other words, the inner wall 76 is positioned more upwardly than the inner wall 75. A front end of the inner wall 76 is positioned more rearwards than a later-mentioned through hole 175.

The inner wall 77 extends rearwards from a lower end of the front wall 144A of the protrusion 144. A front section of the inner wall 77 is positioned between the upper wall 144C of the protrusion 144 and the inner wall 75, in relation to the up-down direction 7, and faces, in the up-down direction 7, the upper wall 144C of the protrusion 144 and the inner wall 75. A rear section of the inner wall 77 is positioned between the inner wall 76 and the inner wall 75 in relation to the up-down direction 7, and faces, in the up-down direction 7, the inner wall 76 and the inner wall 75. A rear end of the inner wall 77 is positioned separated from the inner wall 73, frontwards of the inner wall 73.

The inner walls 78, 79 described below extend rightwards and leftwards from the inner wall 71 (refer to FIGS. 6 and 7). In other words, the inner walls 78, 79 extend from the right end to the left end of the frame 141.

As depicted in FIGS. 4 and 5, the inner wall 78 extends in the up-down direction 7 and the left-right direction 9. The inner wall 78 is provided separated from the front wall 144A rearwards of the front wall 144A of the protrusion 144. As depicted in FIG. 6, the inner wall 78 faces the inner wall 76, sandwiching the through hole 175 between itself and the inner wall 76, in relation to the front-rear direction 8. In other words, the inner wall 78 is provided between the front wall 144A and the through hole 175, in relation to the front-rear direction 8.

The inner wall 79 extends in the up-down direction 7 and the left-right direction 9. The inner wall 79 is positioned more rearwards than the inner wall 74 and more frontwards than the inner wall 69. An upper end of the inner wall 79 is connected to the inner wall 75. A lower end of the inner wall 79 is connected to the inner wall 72. A left end of the inner wall 79 is connected to the left wall 103.

The inner walls 151, 152 described below extend leftwards from the inner wall 71 (refer to FIG. 7). In other words, the inner walls 151, 152 extend from the inner wall 71 to the left end of the frame 141.

As depicted in FIGS. 5 and 7, the inner wall 151 is a wall joining the lower end of the front wall 144A of the protrusion 144 and a rear section of the upper wall 144C of the protrusion 144. The inner wall 151 extends rearwards from the lower end of the front wall 144A, then extends upwardly, then extends rearwards, and then extends upwardly to reach the upper wall 144C.

The inner wall 152 is a wall joining two places of the upper wall 144C of the protrusion 144. Said two places are a front end section of the upper wall 144C and a central section in the front-rear direction 8 of the upper wall 144C. The inner wall 152 extends downwardly from a lower surface of the front end section of the upper wall 144C, then extends rearwards, and then extends upwardly to reach a lower surface of the central section in the front-rear direction 8 of the upper wall 144C. The inner wall 152 is surrounded by the upper wall 144C and the inner wall 151, when the ink tank 100 is viewed from the left.

As depicted in FIG. 4, a right surface of the frame 141 is open. The film 142 is welded to right surfaces of the front wall 101, the lower wall 105, the rear wall 110, the upper wall 104, the inner walls 72-79, the front wall 144A of the protrusion 144, the rear wall 144B of the protrusion 144, and the upper wall 144C of the protrusion 144, whereby an opening of the right surface of the frame 141 is sealed.

As depicted in FIG. 5, a rear section of a left surface of the frame 141 is open. The film 143 is welded to left surfaces of the rear wall 110, the upper wall 104, the inner wall 72, the inner wall 79, the inner wall 151, the inner wall 152, the front wall 144A of the protrusion 144, the rear wall 144B of the protrusion 144, the upper wall 144C of the protrusion 144, and a later-mentioned separating wall 186, whereby an opening of the left surface of the frame 141 is sealed.

As depicted in FIG. 4, an outer surface (front surface) of the upright wall 102 of the front wall 101 includes a first line 146 and a second line 147.

The first line 146 extends in the left-right direction 9. A position in the up-down direction 7 of the first line 146 is at the same height as a liquid surface of the ink when a maximum permissible amount of ink has been stored in the ink chamber 111, in the usable posture of the ink tank 100. Note that the position in the up-down direction 7 of the first line 146 is not limited to being at the same height as the liquid surface of the ink when said maximum amount of ink has been stored in the ink chamber 111.

The second line 147 extends in the left-right direction 9. The second line 147 is positioned more downwardly than the first line 146. In detail, a position in the up-down direction 7 of the second line 147 is at the same height as a liquid surface of the ink when an amount (an example of a second amount) less than the above-described maximum amount of ink has been stored in the ink chamber 111, in the usable posture of the ink tank 100. In the present embodiment, the position in the up-down direction 7 of the second line 147 is at the same height as a liquid surface of the ink when ink of a minimum storage amount at which replenishment of ink becomes required, has been stored in the ink chamber 111, in the usable posture of the ink tank 100.

The frame 141 has translucency, hence the liquid surface of ink stored in the ink tank 100 and the first line 146 and second line 147 can be visually compared via the upright wall 102. The upright wall 102 is an example of a portion of the frame having translucency.

<Ink Chamber 111>

As depicted in FIGS. 4 and 5, the ink chamber 111 is formed on the inside of the casing 140. The ink chamber 111 is an internal space of the ink tank 100, and has ink stored therein. The ink chamber 111 includes the first ink chamber 131 (an example of a first storage chamber) and the second ink chamber 132 (an example of a second storage chamber).

The first ink chamber 131 includes: a space described below; and a first communicating path 171 of an atmosphere communication passage communicated with said space. The second ink chamber 132 includes: a space described below; a second communicating path 172 of the atmosphere communication passage communicated with said space; a buffer chamber 148; and the ink outflow passage 114. The atmosphere communication passage, the buffer chamber 148, and the ink outflow passage 114 will be mentioned later.

The first ink chamber 131 is demarcated by the front wall 101, the left wall 103, the lower wall 105, the rear wall 110, the inner wall 72, the inner wall 73, the inner wall 74, the inner wall 75, the upper wall 104, the inner wall 151, the upper wall 144C of the protrusion 144, the film 142, and the film 143. The front wall 101 demarcates a front surface of the first ink chamber 131. The lower wall 105 and the inner wall 72 demarcate a lower surface of the first ink chamber 131. The inner wall 73 demarcates a rear surface of the first ink chamber 131. The inner wall 75, the inner wall 74, and the upper wall 104 demarcate an upper surface of the first ink chamber 131. The film 142 demarcates a right surface of the first ink chamber 131. The left wall 103 and the film 143 demarcate a left surface of the first ink chamber 131.

The first ink chamber 131 is divided into a front ink chamber 137 and the rear ink chamber 138, by the inner wall 79. A front surface of the inner wall 79 demarcates a rear surface of the front ink chamber 137. A rear surface of the inner wall 79 demarcates a front surface of the rear ink chamber 138.

An upper end section of the inner wall 79 is cut out leftwards from a right end. As a result, an opening 135 is formed in the upper end section of the inner wall 79. The opening 135 is demarcated by the inner wall 79, the inner wall 75, and the film 142. A lower end section of the inner wall 79 is cut out leftwards from a right end. As a result, an opening 136 is formed in the lower end section of the inner wall 79. The opening 136 is demarcated by the inner wall 79, the inner wall 72, and the film 142. The front ink chamber 137 and the rear ink chamber 138 communicate by the openings 135, 136.

As depicted in FIGS. 4 and 6, the second ink chamber 132 is positioned downwardly and rearwards of the first ink chamber 131. The second ink chamber 132 has roughly an L shape, when the ink tank 100 is viewed from the left. The second ink chamber 132 includes a lower ink chamber 51 (an example of a first space) and an upper ink chamber 52 (an example of a second space). The lower ink chamber 51 extends in a long-and-thin manner in the left-right direction 9 along the lower wall 105, downwardly of the first ink chamber 131. The upper ink chamber 52 extends upwardly along the left wall 103 from a rear end section of the lower ink chamber 51. The upper ink chamber 52 is positioned rearwards of the rear ink chamber 138 of the first ink chamber 131.

The lower ink chamber 51 is demarcated by the lower wall 105, the inner wall 72, and the film 142. The lower wall 105 demarcates a front surface, a lower surface, and a left surface of the lower ink chamber 51. The inner wall 72 demarcates an upper surface of the lower ink chamber 51. The film 142 demarcates a right surface of the lower ink chamber 51. A rear end of the lower ink chamber 51 is open. The lower ink chamber 51 communicates with the upper ink chamber 52 at said rear end.

A front end section of the inner wall 72 is cut out leftwards from a right end. As a result, an opening 145 (an example of a first communication port) is formed in the front end section of the inner wall 72. The opening 145 is demarcated by the inner wall 72, the lower wall 105, and the film 142. The front ink chamber 137 of the first ink chamber 131 and the lower ink chamber 51 of the second ink chamber 132 communicate by the opening 145.

The upper ink chamber 52 is demarcated by the rear wall 110, the inner wall 73, and the film 142. The rear wall 110 demarcates a rear surface and a left surface of the upper ink chamber 52. The inner wall 73 demarcates a front surface of the upper ink chamber 52. The film 142 demarcates a right surface of the upper ink chamber 52. A lower end of the upper ink chamber 52 is open. The upper ink chamber 52 communicates with the lower ink chamber 51 at said lower end.

An upper end of the upper ink chamber 52 is open. Now, said upper end (virtual surface) is at the same height as the first line 146. In other words, said upper end is at the same height as a liquid surface of the ink when a maximum permissible amount of ink has been stored in the ink chamber 111, in the usable posture of the ink tank 100. Moreover, the upper ink chamber 52 communicates with the later-mentioned second communicating path 172 of the atmosphere communication passage, at said upper end. That is, said upper end is a boundary of the upper ink chamber 52 and the second communicating path 172. Note that said boundary is not limited to the previously mentioned position, and may be more upward or downward than the first line 146, for example.

A position of a liquid surface of the ink when the maximum permissible amount of ink is stored in the ink chamber 111 in the usable posture of the ink tank 100, in other words, in a state where the upper wall 104 is positioned in an upper section of the ink tank 100 and the lower wall 105 is positioned in a lower section of the ink tank 100, is depicted by the broken line 191 of FIG. 6. In other words, the liquid surface of the ink is at the same height as the first line 146, as mentioned above.

At this time, a height in the vertical direction (a height in the up-down direction 7) of a liquid surface of ink stored in the first ink chamber 131 and a height in the vertical direction (a height in the up-down direction 7) of a liquid surface of ink stored in the second ink chamber 132 are the same.

Moreover, at this time, the liquid surface of ink in the first ink chamber 131 and the liquid surface of ink in the second ink chamber 132 are formed independently of each other. Specifically, the liquid surface of ink in the first ink chamber 131 is surrounded by the front wall 101, the inner wall 73, the film 142, the left wall 103, and the film 143. On the other hand, the liquid surface of ink in the second ink chamber 132 is surrounded by the rear wall 110, the inner wall 73, and the film 142.

A first length L1 of the first ink chamber 131 is longer than a second length L2 of the second ink chamber 132 (L1>L2), in relation to a direction (in the example of FIG. 6, the front-rear direction 8) along the liquid surface of ink (a position depicted by the broken line 191 in FIG. 6) and the film 142, when the maximum permissible amount of ink is stored in the ink chamber 111, in the ink tank 100 in the usable posture. In other words, in the ink tank 100 in the usable posture, when the maximum permissible amount of ink is stored in the ink chamber 111, a length in a direction along the film 142, of the liquid surface of ink of the first ink chamber 131 is longer than a length in a direction along the film 142, of the liquid surface of ink of the second ink chamber 132.

Note that the liquid surface of ink in the first ink chamber 131 and the liquid surface of ink in the second ink chamber 132 being formed independently of each other is not limited to when the maximum permissible amount of ink is stored in the ink chamber 111. For example, the liquid surface of ink in the first ink chamber 131 and the liquid surface of ink in the second ink chamber 132 being formed independently of each other may be when the liquid surface of ink stored in the ink chamber 111 is at the same height as the second line 147 (a position depicted by the broken line 195 in FIG. 6).

In the present embodiment, the first length L1 of the first ink chamber 131 is longer than the second length L2 of the second chamber 132 (L1>L2), even when the liquid surface of ink stored in the ink chamber 111 is at the same height as the second line 147, in the ink tank 100 in the usable posture. Of course, the liquid surface of ink in the first ink chamber 131 and the liquid surface of ink in the second ink chamber 132 may be formed independently of each other when the maximum permissible amount of ink is stored in the ink chamber 111, when the liquid surface of ink stored in the ink chamber 111 is at the same height as the second line 147, and/or when another amount of ink is stored in the ink chamber 111.

Moreover, the liquid surface of ink in the first ink chamber 131 and the liquid surface of ink in the second ink chamber 132 may be formed independently of each other, even when the ink tank 100 is not in the usable posture.

For example, a position of the liquid surface of the ink when the maximum permissible amount of ink is stored in the ink chamber 111, in a state where the lower wall 105 is positioned in the upper section of the ink tank 100 and the upper wall 104 is positioned in the lower section of the ink tank 100, is depicted by the broken line 192 of FIG. 6. That is, the liquid surface of the ink is at the position of the broken line 192 depicted between the first line 146 and the second line 147, in relation to the up-down direction 7.

Moreover, for example, the position of the liquid surface of the ink when the maximum permissible amount of ink is stored in the ink chamber 111, in a state where the front wall 101 is positioned in the upper section of the ink tank 100 and the rear wall 110 is positioned in the lower section of the ink tank 100, is depicted by the one dot-chain line 193 of FIG. 6.

Moreover, for example, the position of the liquid surface of the ink when the maximum permissible amount of ink is stored in the ink chamber 111, in a state where the rear wall 110 is positioned in the upper section of the ink tank 100 and the front wall 101 is positioned in the lower section of the ink tank 100, is depicted by the two dot-chain line 194 of FIG. 6.

<Buffer Chamber 148>

As depicted in FIGS. 4 and 6, the buffer chamber 148 is formed on the inside of the casing 140. The buffer chamber 148 is an internal space of the ink tank 100 and interposes between the second ink chamber 132 and the later-mentioned ink outflow passage 114. In other words, ink stored in the second ink chamber 132 flows into the ink outflow passage 114 via the buffer chamber 148.

The buffer chamber 148 is provided on a right side of a rear lower section of the casing 140. The buffer chamber 148 is demarcated by an inner wall 153, an inner wall 154, an inner wall 155, the lower wall 105, the rear wall 110, and the film 142.

The inner wall 153 protrudes frontwards from a front surface in a right lower section of the rear wall 110 and extends in the left-right direction 9. The inner wall 153 demarcates an upper surface of the buffer chamber 148. The inner wall 154 protrudes upwardly from an upper surface in a right rear section of the lower wall 105 and extends in the left-right direction 9. The inner wall 154 demarcates a front surface of the buffer chamber 148. The inner wall 155 is a wall extending in the up-down direction 7 and the front-rear direction 8, and is surrounded by the inner wall 153, the inner wall 154, the rear wall 110, and the lower wall 105. The inner wall 155 demarcates a left surface of the buffer chamber 148. The lower wall 105 demarcates a lower surface of the buffer chamber 148. The rear wall 110 demarcates a rear surface of the buffer chamber 148. The film 142 demarcates a right surface of the buffer chamber 148.

A right lower end section of the inner wall 154 is cut out leftwards from a right end. As a result, an opening 149 (an example of a second communication port) is formed in the right lower end section of the inner wall 154. The opening 149 is demarcated by the inner wall 154 and the film 142. The opening 149 communicates a right side of a rear lower section of the second ink chamber 132 and the buffer chamber 148. Note that in the present embodiment, the inner wall 154 is cut out in a semicircular shape, but a shape of a cut-out is not limited to a semicircular shape, and may be a rectangular shape, for example.

A circular-shaped opening 150 is formed in a central section of the inner wall 155. The opening 150 communicates the buffer 148 and the ink outflow passage 114. Ink stored in the second ink chamber 132 flows into the opening 150 via the buffer chamber 148. In other words, the opening 150 is an ink inflow port (an example of a liquid inflow port) for ink to flow from the buffer chamber 148 into the ink outflow passage 114. Note that a shape of the opening 150 is not limited to a circular shape, and may be the likes of a rectangular shape, for example.

<Ink Outflow Passage 114>

As depicted in FIGS. 5 and 7, the casing 140 includes the ink outflow passage 114. The ink outflow passage 114 is a communicating path for ink stored in the second ink chamber 132 to flow out to outside of the ink tank 100. Note that in the present embodiment, since ink stored in the first ink chamber 131 moves to the second ink chamber 132 via the opening 145, it could also be said that the ink outflow passage 114 is a communicating path for ink stored in the first ink chamber 131 and the second ink chamber 132 to flow out to outside of the ink tank 100.

The ink outflow passage 114 communicates with the buffer chamber 148 via the opening 150. The ink outflow passage 114 extends leftwards from the opening 150, then extends upwardly, then extends downwardly, and then extends rightwards to reach an opening 156.

The ink outflow passage 114 is formed as a trench recessed rightwards from a left surface of the rear wall 110. A portion excluding a left surface and part of a right surface of the ink outflow passage 114 is demarcated by the rear wall 110. A peripheral portion of the opening 156 in the right surface of the ink outflow passage 114 is demarcated by the inner wall 155. The left surface of the ink outflow passage 114 is demarcated by the film 143.

The frame 141 includes a tubular protrusion 157. The protrusion 157 protrudes rearwards from the peripheral portion of the opening 156 of the rear wall 110. A front end of an internal space of the protrusion 157 communicates with the ink outflow passage 114 via the opening 156. A rear end of the internal space of the protrusion 157 communicates with outside of the ink tank 100 by an opening 158. The ink tube 32 is connected to the protrusion 157 via the opening 158.

As described above, one end of the ink outflow passage 114 communicates with the second ink chamber 132 via the buffer chamber 148. Moreover, the other end of the ink outflow passage 114 communicates with the nozzle 40 of the recording head 39 via the internal space of the protrusion 157 and the ink tube 32. In other words, ink that has flowed in from the opening 150 flows out from the opening 158 toward the recording head 39. Moreover, when ink is consumed by ink droplets being discharged from the recording head 39, ink in the ink outflow passage 114 moves toward the recording head 39.

Now, the ink outflow passage 114 is a flow path. The flow path refers to a space whose one end is connected to the ink chamber 111 and into which, when its other end is blocked, ink stored in the ink chamber 111 does not flow regardless of posture of the ink tank 100. In the present embodiment, the ink tank 100 includes only the ink outflow passage 114 as a flow path, but may include a flow path other than the ink outflow passage 114.

As mentioned above, the tube extending from the cap of the maintenance mechanism capable of covering the nozzle 40 of the recording head 39 is blocked by the pump. Hence, when the nozzle 40 is covered by the cap, the other end (an end on a protrusion 157 side) of the ink outflow passage 114 communicates with the blocked tube via the internal space of the protrusion 157, the ink tube 132, the recording head 39, and the cap. In other words, the other end of the ink outflow passage 114 is blocked. Moreover, a cross-sectional area of the ink outflow passage 114 is configured to be sufficiently smaller compared to a cross-sectional area of the second ink chamber 132. Therefore, even if the ink tank 100 is in a posture other than the usable posture, in other words, regardless of the posture of the ink tank 100, ink stored in the second ink chamber 132 never flows into the ink outflow passage 114. Note that when the nozzle 40 is not covered by the cap, the nozzle 40 is open. In other words, the other end of the ink outflow passage 114 is open. Therefore, ink stored in the second ink chamber 132 can flow into the ink outflow passage 114.

On the other hand, the above-mentioned opening 145 and the later-mentioned atmosphere communication passage are a boundary. The boundary refers to a space at least one of whose one end or other end is connected to the ink chamber 111 and into which ink stored in the ink chamber 111 can flow even supposing the one end or the other end is blocked. In the present embodiment, the ink tank 100 includes only the opening 145 and the atmosphere communication passage as a boundary, but may include a boundary other than the opening 145 and the atmosphere communication passage.

<Atmosphere Communication Passage>

As depicted in FIGS. 4 to 7, the casing 140 includes the atmosphere communication passage. The atmosphere communication passage is a communicating path for communicating the ink chamber 111 and outside of the ink tank 100. In other words, the atmosphere communication passage is a communicating path for opening the ink chamber 111 to the air. The atmosphere communication passage includes: the first communicating path 171 and the second communicating path 172 depicted in FIGS. 4 and 6; and a third communicating path 173 depicted in FIGS. 4 to 7. The first communicating path 171 and the second communicating path 172 are positioned more rightwards than the inner wall 71. The third communicating path 173 is positioned both rightwards and leftwards of the inner wall 71.

As depicted in FIGS. 4 and 6, the first communicating path 171 communicates with the front ink chamber 137 of the first ink chamber 131 via an opening 174. The opening 174 is formed by a right front end section of the inner wall 75 being cut out leftwards from a right end. The opening 174 is demarcated by the inner wall 75, the inner wall 74, and the film 142.

The first communicating path 171 extends rearwards from the opening 174, and then extends frontwards making a U-turn to reach the through hole 175 (refer to FIGS. 6 and 7). The through hole 175 is provided in the inner wall 71. The through hole 175 is provided somewhat more frontwards than a center of the protrusion 144, in relation to the front-rear direction 8. The through hole 175 communicates with rightward and leftward of the inner wall 71.

The first communicating path 171 has its front/rear and upper/lower surfaces demarcated by the upper wall 104, the inner wall 73, the inner wall 74, the inner wall 75, the inner wall 76, and the inner wall 77. Moreover, the first communicating path 171 has its left surface demarcated by the inner wall 71, and has its right surface demarcated by the film 142.

A lower end of the second communicating path 172 communicates with an upper end (virtual surface) of the upper ink chamber 52 of the second ink chamber 132. The second communicating path 172 extends upwardly from a communicating position with the upper ink chamber 52, then extends frontwards, then extends upwardly, and then extends frontwards to reach the through hole 175.

The second communicating path 172 has its rear surface and its upper surface demarcated by the rear wall 110, the upper wall 104, the rear wall 144B of the protrusion 144, and the upper wall 144C of the protrusion 144. In addition, the second communicating path 172 has its front surface and its lower surface demarcated by the inner wall 73 and the inner wall 76. Moreover, the second communicating path 172 has its left surface demarcated by the inner wall 71, and has its right surface demarcated by the film 142.

As depicted in FIGS. 5 and 7, the third communicating path 173 includes a leftward communicating path 176, a rightward communicating path 177, a rearward communicating path 178, and a labyrinth 179.

The leftward communicating path 176 extends leftwards from the through hole 175 (refer to FIGS. 6 and 7) to a left end of the frame 141. The leftward communicating path 176 communicates with the first communicating path 171 and the second communicating path 172 via the through hole 175. The leftward communicating path 176 communicates with the rightward communicating path 177 via an opening 180. The opening 180 is formed by a left lower end section of the inner wall 78 being cut out rightwards from a left end. The opening 180 is demarcated by the inner wall 78, the inner wall 152, and the film 143.

The leftward communicating path 176 has its front surface demarcated by the inner wall 78, has its rear surface and its lower surface demarcated by the inner wall 152, has its upper surface demarcated by the upper wall 144C of the protrusion 144, and has its left surface demarcated by the film 143.

The rightward communicating path 177 extends rightwards from the opening 180 to a right end of the frame 141. As depicted in FIGS. 4, 6, and 7, an opening 181 is formed in a portion where the rightward communicating path 177 is formed in the inner wall 71. A left side and a right side of the inner wall 71 in the rightward communicating path 177 are communicated by the opening 181.

As depicted in FIG. 4, a surrounding wall 182 protrudes rightwards from a peripheral edge of the opening 181 in the inner wall 71. A lower inner surface 182A of the surrounding wall 182 inclines such that its right end is positioned more upwardly than its left end. A semipermeable membrane 183 (refer to FIG. 4) is attached to a protruding tip surface of the surrounding wall 182, in other words to a right surface of the surrounding wall 182. As a result, the rightward communicating path 177 is blocked by the semipermeable membrane 183.

The semipermeable membrane 183 is a porous membrane having minute holes that block passage of ink and allow passage of a gas. For example, the semipermeable membrane 183 is configured from a fluororesin such as polytetrafluoroethylene, polychlorotrifluoroethylene, a tetrafluoroethylene-hexafluoropropylene copolymer, a tetrafluoroethylene-perfluoroalkylvinylether copolymer, a tetrafluoroethylene-ethylene copolymer, and so on.

As depicted in FIGS. 5 and 7, a portion on a side more leftward than the inner wall 71 of the rightward communicating path 177 has its front surface and its lower surface demarcated by the inner wall 152, has its rear surface demarcated by the inner wall 78, has its upper surface demarcated by the upper wall 144C of the protrusion 144, has a portion excluding the opening 181 of its right surface demarcated by the inner wall 71 (refer to FIG. 6), and has its left surface demarcated by the film 143.

Moreover, as depicted in FIGS. 4 and 6, a portion on a side more rightward than the inner wall 71 of the rightward communicating path 177 has its front surface demarcated by the front surface 144A of the protrusion 144, has its lower surface demarcated by the inner wall 77 and the lower inner surface 182A of the surrounding wall 182, has its rear surface demarcated by the inner wall 78, has its upper surface demarcated by the upper wall 144C of the protrusion 144, has a portion excluding the opening 181 of its left surface demarcated by the inner wall 71, and has its right surface demarcated by the film 142.

As depicted in FIGS. 5 and 7, the rearward communicating path 178 communicates with a portion on the side more rightward than the inner wall 71 of the rightward communicating path 177, via an opening 184 (refer to FIGS. 6 and 7) formed between the front wall 144A of the protrusion 144 and the inner wall 71. The rearward communicating path 178 extends leftwards from the opening 184, and then extends rearwards to reach the labyrinth 179 via an opening 185 formed between the inner wall 151 and the inner wall 152.

The rearward communicating path 178 has its lower surface and its front surface demarcated by the inner wall 151 and the front wall 144A of the protrusion 144, has its rear surface and its upper surface demarcated by the inner wall 152, has its right surface demarcated by the inner wall 71, and has its left surface demarcated by the film 143.

The labyrinth 179 is a communicating path that, by a plurality of separating walls 186 that extend in the up-down direction 7 being provided aligned in the front-rear direction 8, extends along the front-rear direction 8 while repeating U-turns in the up-down direction 7. One end (a front lower end) of the labyrinth 179 communicates with the rearward communicating path 178 via the opening 185. The other end (a rear upper end) of the labyrinth 179 communicates with the air opening port 187 (refer to FIG. 5).

The air opening port 187 is configured as a hole penetrating in the up-down direction 7 the upper wall 144C of the protrusion 144. A lower end of the air opening port 187 communicates with the labyrinth 179. An upper end of the air opening port 187 communicates with outside of the ink tank 100. The air opening port 187 is positioned more upwardly than the liquid surface of ink when the maximum permissible amount of ink has been stored in the ink chamber 111, in the usable posture of the ink tank 100.

From the above, as depicted in FIG. 4, the atmosphere communication passage communicates with the first ink chamber 131 of the ink chamber 111 at the opening 174, and communicates with the second ink chamber 132 of the ink chamber 111 at a lower end of the second communicating path 172. On the other hand, as depicted in FIG. 5, the atmosphere communication passage communicates with outside of the ink tank 100 at the air opening port 187.

<Ink Tank 100B>

Figure 8:
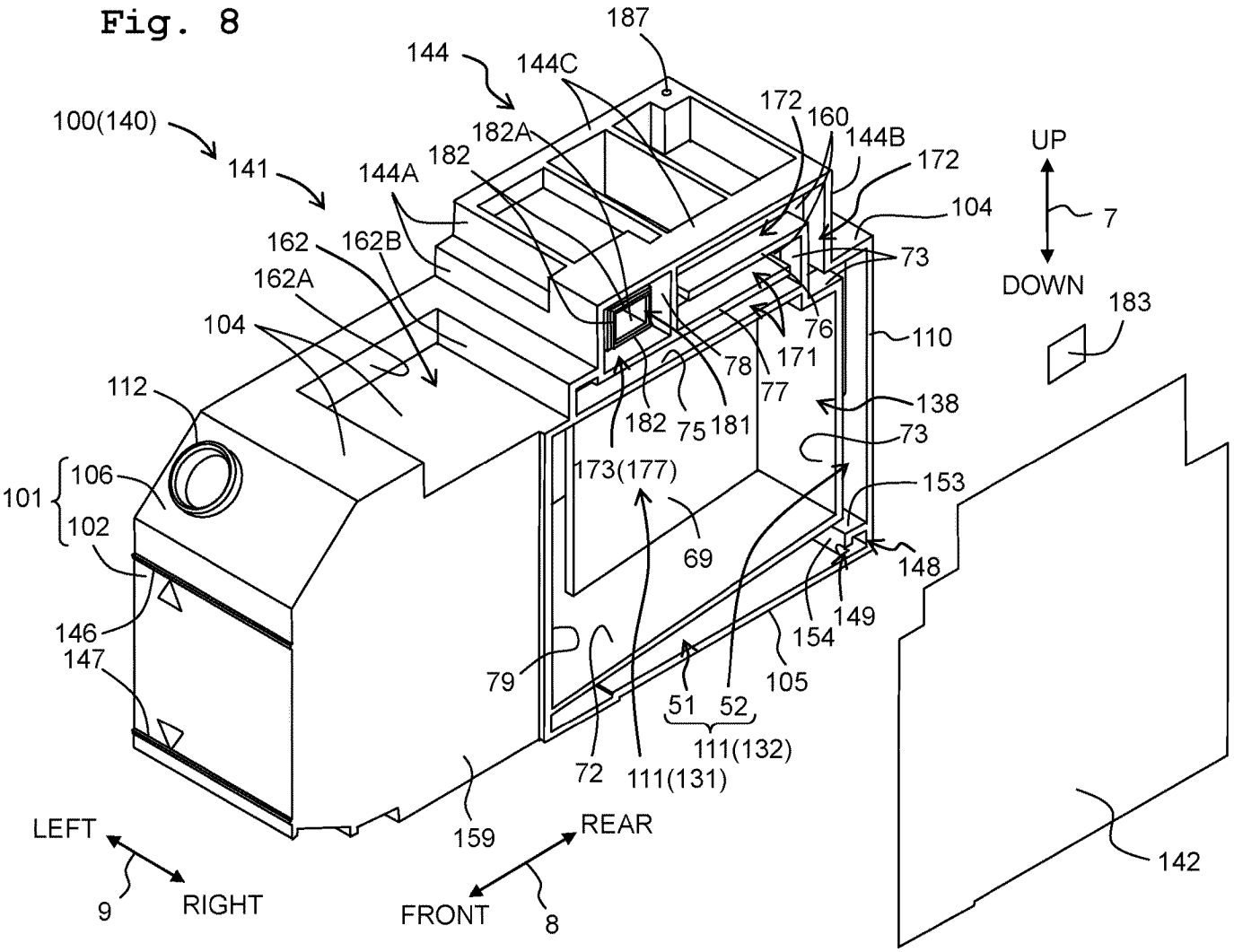
FIG. 8 is a front perspective view of an ink tank for a black ink.
Figure 9:
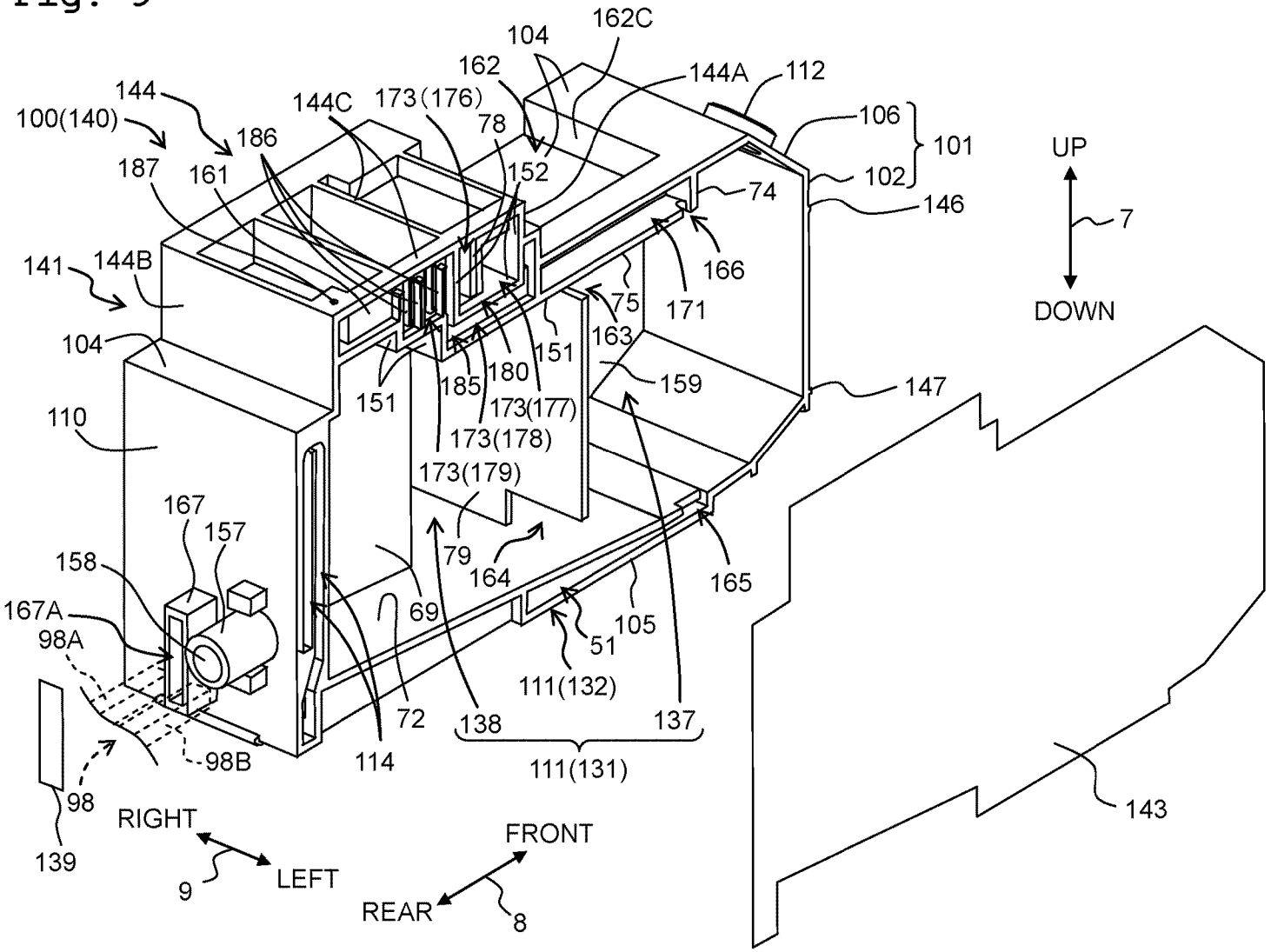
FIG. 9 is a rear perspective view of the ink tank for the black ink.

A configuration of the ink tank 100B will be described below with reference to FIGS. 8 to 11. As depicted in FIGS. 8 and 9, the ink tank 100B is longer in the left-right direction 9 than the ink tanks 100Y, 100C, 100M (refer to FIGS. 4 and 5).

Portions different from the ink tanks 100Y, 100C, 100M, of the ink tank 100B will be described below. Note that portions having the same configuration as in the ink tanks 100Y, 100C, 100M in the ink tank 100B will be assigned with the same reference symbols as in FIGS. 4 to 7, whereupon descriptions thereof will be omitted. Moreover, in the case that a configuration of a certain portion in the ink tank 100B differs only in being longer in the left-right direction 9 than a configuration of a portion corresponding to said certain portion of the ink tanks 100Y, 100C, 100M, the portion corresponding to said certain portion in the ink tank 100B will be assigned with the same reference symbol as in FIGS. 4 to 7, whereupon a description thereof will be omitted.

Figure 10:
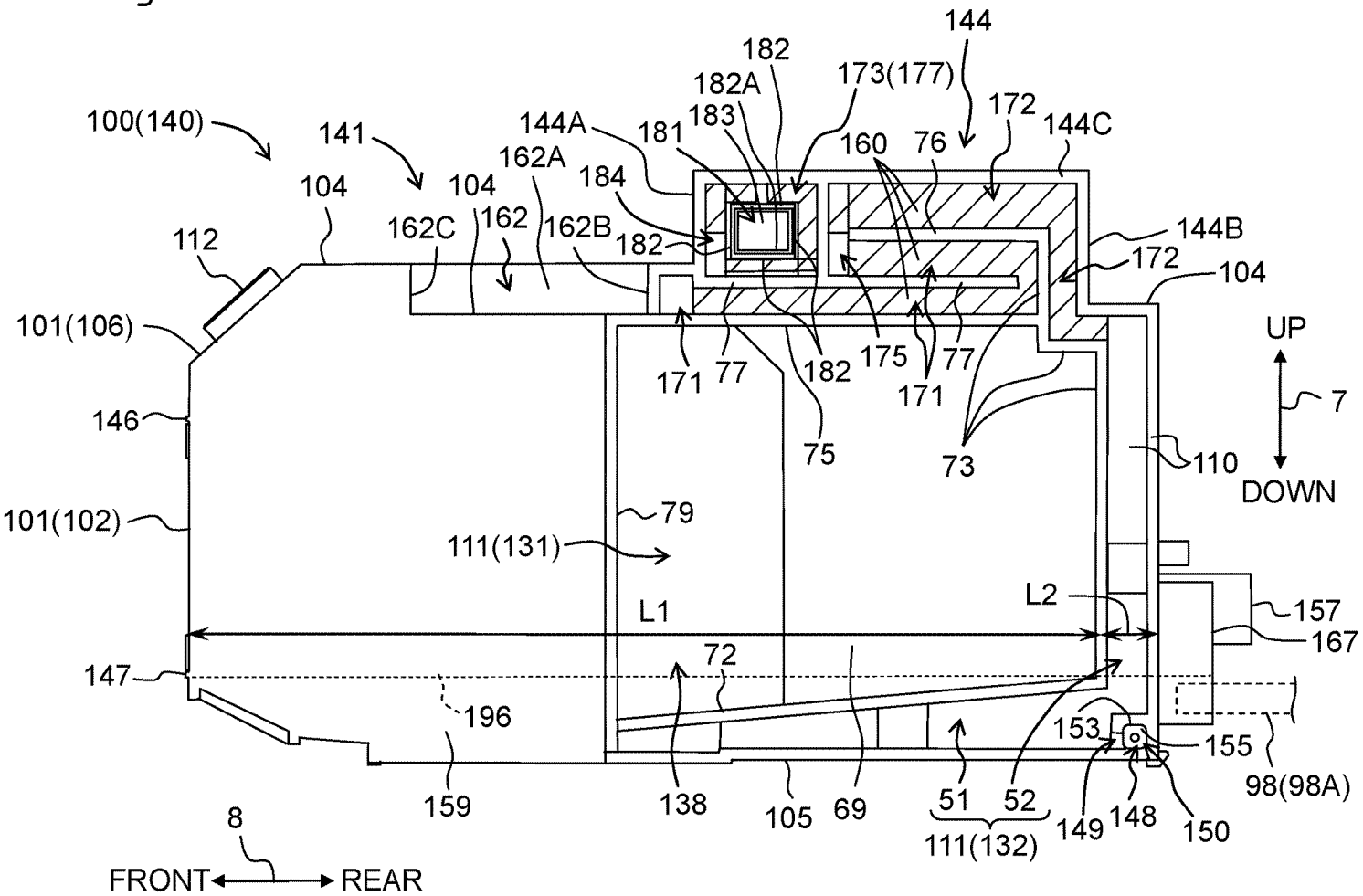
FIG. 10 is a right side view of the ink tank for the black ink.

As depicted in FIGS. 8 and 10, the ink tank 100B includes a right wall 159, but does not include the left wall 103 (refer to FIG. 5) which is included in the ink tanks 100Y, 100C, 100M. The right wall 159 is a wall extending rearwards from a right end of the front wall 101. An upper end of the right wall 159 is connected to a front section of the upper wall 104. A lower end of the right wall 159 is connected to a front section of the lower wall 105. In other words, the right wall 159 is a wall joining the right end of the front wall 101, a front section right end of the upper wall 104, and a front section right end of the lower wall 105. In other words, the right wall 159 is provided only in the front section of the frame 141, and is not provided in the rear section of the frame 141.

As depicted in FIGS. 8 and 10, the ink tank 100B includes the right wall 159 (an example of a side wall), but does not include the left wall 103 (refer to FIG. 5). The right wall 159 extends rearwards from a right end of the front wall 101. An upper end of the right wall 159 is connected to the front section of the upper wall 104. A lower end of the right wall 159 is connected to the front section of the lower wall 105. In other words, the right wall 159 is provided only in the front section of the frame 141, and is not provided in the rear section of the frame 141.

As depicted in FIGS. 8 and 9, a recess 162 is formed in the front section of the upper wall 104. The recess 162 is demarcated by side walls 162A, 162B, 162C and the upper wall 104.

The ink tank 100B does not include the inner wall 71 (refer to FIG. 6). The ink tank 100B includes an inner wall 160 (refer to FIGS. 8 and 10) and an inner wall 161 (refer to FIGS. 9 and 11) as walls corresponding to the inner wall 71 (refer to FIG. 6).

The inner wall 160 and the inner wall 161 extend downwardly from the upper wall 104 and the upper wall 144C of the protrusion 144. The inner wall 160 and the inner wall 161 are walls extending in the up-down direction 7 and the front-rear direction 8.

The inner wall 160 is provided in a range of hatching depicted in FIG. 10. The inner wall 160 is provided at a position between the right end and the left end of the frame 141, in relation to the left-right direction 9. For example, the inner wall 160 is provided more to a right side than a center of the frame 141, in relation to the left-right direction 9.

Figure 11:
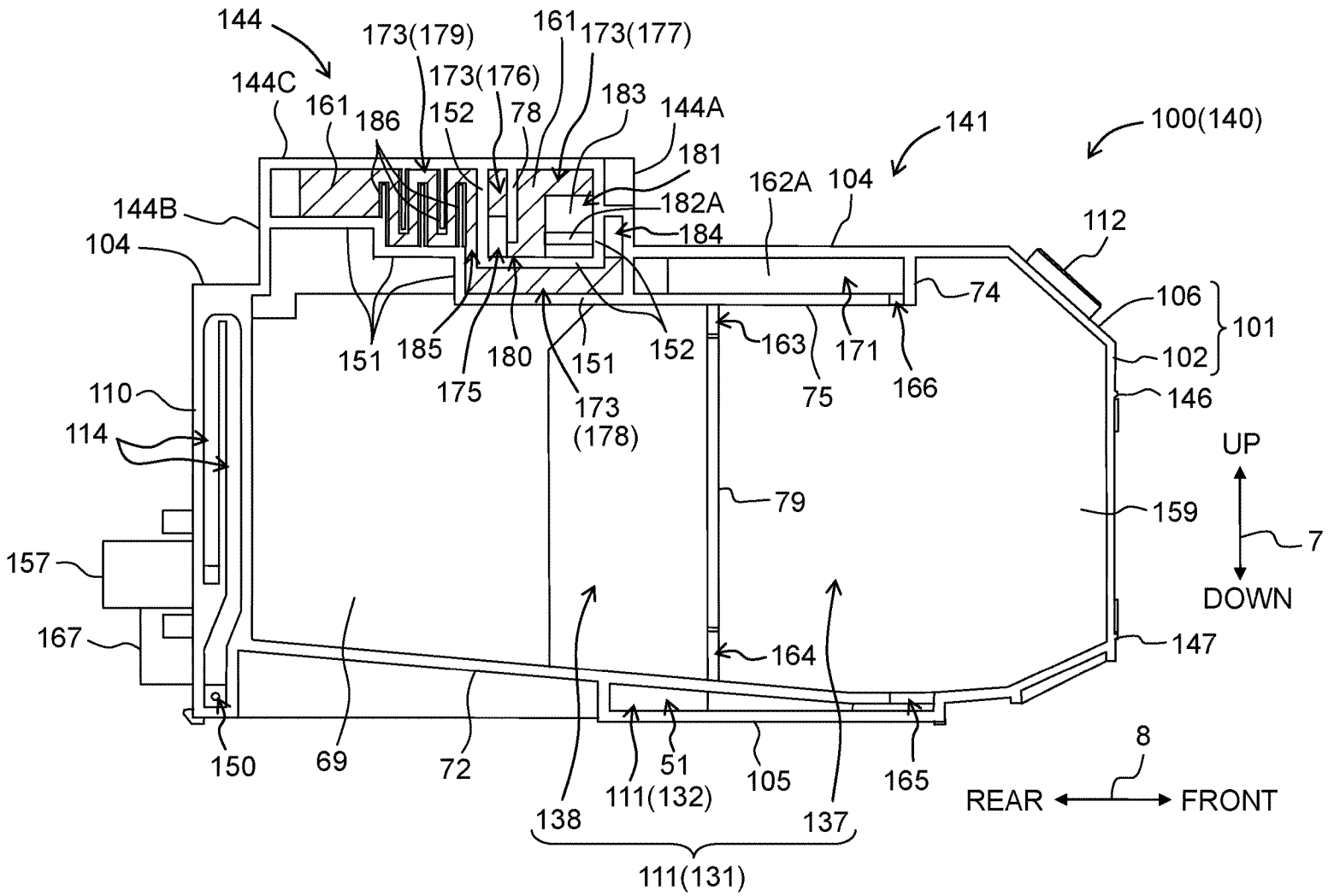
FIG. 11 is a left side view of the ink tank for the black ink.

The inner wall 161 is provided in a range of hatching depicted in FIG. 11. The inner wall 161 is provided at a position more to a left side than the inner wall 160 between the right end and the left end of the frame 141, in relation to the left-right direction 9. For example, the inner wall 161 is provided more to a left side than the center of the frame 141, in relation to the left-right direction 9.

As depicted in FIGS. 8 and 10, a portion more upward than the inner wall 75 of the inner wall 73, a portion on an inner wall 73 side of the inner wall 75, the inner wall 76, and the inner wall 77 extend rightwards from the inner wall 160. In other words, the portion more upward than the inner wall 75 of the inner wall 73, the portion on the inner wall 73 side of the inner wall 75, the inner wall 76, and the inner wall 77 are provided more to a right side than the inner wall 160.

As depicted in FIGS. 9 and 11, the inner wall 74 and a portion on an inner wall 74 side of the inner wall 75 extend leftwards from the side wall 162A. In other words, the inner wall 74 and the portion on the inner wall 74 side of the inner wall 75 are provided more to a left side than the side wall 162A.

As depicted in FIGS. 9 and 11, the inner wall 74 extends downwardly from a left front section of the upper wall 104. The inner wall 74 is connected to the side wall 162A, but is not connected to the inner wall 160 and the inner wall 161.

The inner wall 75 extends rearwards from a lower end of the inner wall 74. A portion extending rearwards, of the inner wall 75 extends leftwards from the side wall 162A. Then, the inner wall 75 extends rightwards. A portion extending rightwards, of the inner wall 75 has its front end connected to the side wall 162B (refer to FIG. 8) and has its rear end connected to the front wall 144A of the protrusion 144 (refer to FIGS. 8 and 11). Then, the inner wall 75 extends rearwards. A portion extending rearwards, of the inner wall 75 extends rightwards from the inner wall 160.

As depicted in FIGS. 8 and 10, a right end of the inner wall 79 is connected to the right wall 159.

As depicted in FIGS. 9 and 11, the inner wall 151 is a wall joining the lower end of the front wall 144A of the protrusion 144 and the rear wall 144B of the protrusion 144. The inner wall 151 extends rearwards from the lower end of the front wall 144A, then extends upwardly, then extends rearwards, then extends upwardly, and then extends rearwards to reach the rear wall 144B.

As depicted in FIG. 8, a rear section of the right surface of the frame 141 is open. The film 142 is welded to right surfaces of the lower wall 105, the rear wall 110, the upper wall 104, the inner walls 72, 73, 75-79, the side wall 162B of the recess 162, the front wall 144A of the protrusion 144, the rear wall 144B of the protrusion 144, and the upper wall 144C of the protrusion 144, whereby an opening of the right surface of the frame 141 is sealed.

As depicted in FIG. 9, the left surface of the frame 141 is open. The film 143 is welded to left surfaces of the rear wall 110, the upper wall 104, the lower wall 105, the inner wall 72, the inner wall 74, the inner wall 75, the inner wall 78, the inner wall 79, the inner wall 151, the inner wall 152, the front wall 144A of the protrusion 144, the rear wall 144B of the protrusion 144, the upper wall 144C of the protrusion 144, and the separating wall 186, whereby an opening of the left surface of the frame 141 is sealed.

As depicted in FIGS. 8 and 9, the first ink chamber 131 is demarcated by the front wall 101, the right wall 159, the lower wall 105, the rear wall 110, the inner wall 72, the inner wall 73, the inner wall 74, the inner wall 75, the upper wall 104, the inner wall 151, the film 142, and the film 143. The right wall 159 and the film 142 demarcate the right surface of the first ink chamber 131.

As depicted in FIG. 9, an upper end section of the inner wall 79 is cut out rightwards from a left end. As a result, an opening 163 is formed in the upper end section of the inner wall 79. The opening 163 is demarcated by the inner wall 79, the inner wall 75, and the film 143. A lower end section of the inner wall 79 is cut out rightwards from a left end. As a result, an opening 164 is formed in the lower end section of the inner wall 79. The opening 164 is demarcated by the inner wall 79, the inner wall 72, and the film 143. The front ink chamber 137 and the rear ink chamber 138 communicate by the openings 163, 164.

A front end section of the inner wall 72 is cut out rightwards from a left end. As a result, an opening 165 (an example of a first communication port) is formed in the front end section of the inner wall 72. The opening 165 is demarcated by the inner wall 72, the lower wall 105, and the film 143. The front ink chamber 137 of the first ink chamber 131 and the lower ink chamber 51 of the second ink chamber 132 communicate by the opening 165.

As depicted in FIGS. 8 and 10, the first communicating path 171 and the second communicating path 172 are positioned more rightwards than the inner wall 160. As depicted in FIGS. 8 to 11, the third communicating path 173 is positioned both rightwards of the inner wall 160 and leftwards of the inner wall 161.

As depicted in FIG. 9, the first communicating path 171 communicates with the front ink chamber 137 of the first ink chamber 131 via an opening 166. The opening 166 is formed by a left front end section of the inner wall 75 being cut out rightwards from a left end. The opening 166 is demarcated by the inner wall 75, the inner wall 74, and the film 143.

The first communicating path 171 extends rearwards from the opening 166, and then extends rightwards. Then, as depicted in FIG. 8, the first communicating path 171 extends rearwards, and then extends frontwards making a U-turn to reach the through hole 175 (refer to FIG. 10). The through hole 175 is a hole penetrating the inner wall 160 and the inner wall 161 in the left-right direction 9, and connects the first communicating path 171 and second communicating path 172 and the third communicating path 173.

As depicted in FIG. 9, a portion extending rearwards from the opening 166 in the first communicating path 171 is demarcated by the upper wall 104, the side wall 162A of the recess 162, the inner wall 74, the inner wall 75, and the film 143. A portion extending rightwards in the first communicating path 171 is demarcated by the upper wall 104, the side wall 162B of the recess 162, the inner wall 75, and the front wall 144A of the protrusion 144. As depicted in FIG. 8, a portion more rightward than the inner wall 160 in the first communicating path 171 is demarcated by the inner wall 160, the inner wall 73, the inner wall 75, the inner wall 76, the inner wall 77, and the film 142.

Note that as depicted in FIG. 10, a first length L1 of the first ink chamber 131 is longer than a second length L2 of the second ink chamber 132 (L1>L2), in relation to a direction (in the example of FIG. 10, the front-rear direction 8) along the liquid surface of ink (a position depicted by the broken line 196 in FIG. 10) and the film 142, when the liquid surface of ink stored in the ink chamber 111 is at the same height as the second line 147, in the ink tank 100B in the usable posture. In other words, in the ink tank 100B in the usable posture, when the liquid surface of ink stored in the ink chamber 111 is at the same height as the second line 147, a length in a direction along the film 142, of the liquid surface of ink of the first ink chamber 131 is longer than a length in a direction along the film 142, of the liquid surface of ink of the second ink chamber 132. Similarly, the first length L1 of the first ink chamber 131 in a direction along the liquid surface of ink and the film 142, when the liquid surface of ink stored in the ink chamber 111 is at the same height as the first line 146, is longer than the second length L2 of the second ink chamber 132 in the front-rear direction 8 (L1>L2).

As depicted in FIG. 9, the frame 141 includes a protrusion 167 (an example of a residual amount detector) protruding rearwards from the rear wall 110. The protrusion 167 detects a height of the liquid surface of ink stored in the ink chamber 111 of the ink tank 100 in the usable posture, by being irradiated with light by a later-mentioned optical sensor 98. The protrusion 167 is formed by a pair of outer walls that face each other separated in each of the up-down direction 7 and the left-right direction 9, and overall has roughly a rectangular parallelepiped shape. Each of the outer walls configuring the protrusion 167 has translucency. The protrusion 167 has an internal space 167A, and a front end and a rear end of the protrusion 167 are open. A front end of the internal space 167A of the protrusion 167 communicates with the upper ink chamber 52 of the second ink chamber 132, in a manner enabling ink to flow. In other words, the internal space 167A is provided in the second ink chamber 132. The rear end of the protrusion 167 is open. The open rear end of the protrusion 167 is blocked by a film 139 being attached to it.

When a horizontal cross section of the ink tank 100 at a height of not more than an upper end and not less than a lower end of the internal space 167A of the protrusion 167 is viewed from above, a cross-sectional area of the second ink chamber 132 is smaller than a cross-sectional area of the first ink chamber 131. Moreover, the internal space 167A of the protrusion 167 communicates with the second ink chamber 132 of small cross-sectional area.

Note that in the present embodiment, the internal space 167A of the protrusion 167 has communicated with the second ink chamber 132, but the internal space 167A may communicate with the first ink chamber 131. In other words, the internal space 167A may be provided in the first ink chamber 131. In this case, the protrusion 167 may protrude from the front wall 101 or the left wall 103, for example.

Moreover, in the present embodiment, the protrusion 167 is provided only in the ink tank 100B, of the ink tanks 100B, 100Y, 100C, 100M. However, the protrusion 167 may be provided in at least one of the ink tanks 100B, 100Y, 100C, 100M.

<Optical Sensor 98>

The printer unit 11 includes the optical sensor 98. The optical sensor 98 is installed in the casing 14. As depicted by the broken lines in FIG. 9, the optical sensor 98 is positioned rightwards and leftwards of the protrusion 167 of the frame 141 of the ink tank 100B, in a state where the tank set 99 has been installed on the inside of the casing 14.

The optical sensor 98 includes a light-emitting section 98A and a light-receiving section 98B. The light-emitting section 98A and the light-receiving section 98B are disposed in the left-right direction 9 sandwiching the protrusion 167. The light-emitting section 98A is disposed rightwards of the protrusion 167. The light-receiving section 98B is disposed leftwards of the protrusion 167. Note that arrangement positions of the light-emitting section 98A and the light-receiving section 98B may be left and right reversed.

Arrangement positions in the up-down direction 7 of the light-emitting section 98A and the light-receiving section 98B are determined such that a position of irradiation of light to the light-receiving section 98B in the light-emitting section 98A and a position of light reception of light from the light-emitting section 98A in the light-receiving section 98B are at the second line 147 or lower. In the present embodiment, as depicted in FIG. 10, the optical sensor 98 is positioned more downwardly than the second line 147. In other words, a height of a position corresponding to an optical path of light irradiated from the optical sensor 98 in the protrusion 167 is at a lower position than the broken line depicted in FIG. 10. Now, said broken line indicates the liquid surface of ink of a minimum storage amount at which replenishment of ink becomes required in the ink tank in the usable posture. From the above, a position in the up-down direction 7 of the protrusion 167 includes a position more downward than the second line 147.

The optical sensor 98 is electrically connected to a control unit (not illustrated) of the multifunction peripheral 10 via an electrical circuit.

Light is irradiated from the light-emitting section 98A toward the light-receiving section 98B. The irradiated light penetrates the protrusion 167 to enter the internal space 167A of the protrusion 167. When the liquid surface of ink stored in the internal space 167A is more upward than the optical path, the light is blocked by the ink stored in the internal space 167A to be prevented from reaching the light-receiving section 98B. As a result, a low level signal is outputted from the optical sensor 98 to the control unit. On the other hand, when the liquid surface of ink is more downward than the optical path, the light proceeds through the air in the internal space 167A. In this case, the light penetrates the internal space 167A to reach the light-receiving section 98B. As a result, a high level signal is outputted from the optical sensor 98 to the control unit.

The control unit determines that the liquid surface of ink stored in the ink chamber 111 is higher than the second line 147 when the signal outputted from the optical sensor 98 is low level, and determines that the liquid surface of ink stored in the ink chamber 111 is lower than the second line 147 when the signal outputted from the optical sensor 98 is high level.

<Inlet 112>

As depicted in FIG. 1B, the inclined walls 106 of each of the ink tanks 100B, 100Y, 100C, 100M are respectively provided with inlets 112B, 112Y, 112C, 112M (these are sometimes described collectively as "inlet 112") for filling ink into the first ink chamber 131 of the ink chamber 111. The inlet 112 (an example of a liquid inlet) penetrates the inclined wall 106 in a thickness direction to communicate a corresponding first ink chamber 131 with outside of the ink tank 100. An inner surface of the inclined wall 106 faces the front ink chamber 137 of the first ink chamber 131. An outer surface of the inclined wall 106 faces outside of the ink tank 100. Therefore, the inlet 112 directly communicates the first ink chamber 131 and outside of the ink tank 100. In other words, in the present embodiment, the inlet 112 is provided in the first ink chamber 131 which is not provided with the protrusion 167. Note that the inlet 112 may be provided for filling ink into the second ink chamber 132.

The inclined wall 106 and the inlet 112 provided in the inclined wall 106 are exposed to outside of the multifunction peripheral 10 via the opening 22, by positioning the cover 70 in the open position. A posture (filling posture) of the ink tank 100 when ink is filled into the first ink chamber 131 via the inlet 112, is the usable posture. That is, ink is filled into the first ink chamber 131 via the inlet 112 when the ink tank 100 is in the usable posture.

<Cap 113>

As depicted in FIGS. 1A and 1B, the ink tank 100 has caps 113B, 113Y, 113C, 113M that are attachable to/detachable from the inclined wall 106 so as to block the inlet 112. The four caps 113B, 113Y, 113C, 113M correspond respectively to the four inlets 112B, 112Y, 112C, 112M of the ink tank 100. As depicted in FIG. 1A, the cap 113 installed in the inclined wall 106 closely contacts a wall surface demarcating a peripheral edge of the inlet 112 and thereby blocks the inlet 112. On the other hand, as depicted in FIG. 1B, the cap 113 removed from the inclined wall 106 opens the inlet 112. The cap 113 is attached to/detached from the inclined wall 106 in a state of the cover 70 being positioned in the open position. Moreover, removing the cap 113 from the inlet 112 makes it possible to fill ink into the ink chamber 111 via the inlet 112.

<Cover 70>

As depicted in FIG. 1, the cover 70 is provided so as to enable opening/closing of the opening 22 formed in the front wall 14A of the casing 14. The cover 70 pivots around the pivotal axis 70A extending in the left-right direction 9. The cover 70 has an outer shape of a size corresponding to the opening 22, and has a box-like shape opening toward the opening 22. The cover 70 in the closed position covers the upright wall 102 and the inclined wall 106 of the front wall 101 of the ink tank 100. The cover 70 in the open position exposes the upright wall 102 and the inclined wall 106 of the front wall 101 of the ink tank 100, to outside of the casing 14.

<Pressure Loss of Lower Ink Chamber 51 and Upper Ink Chamber 52>

As depicted in FIG. 6, the second ink chamber 132 includes: the lower ink chamber 51 extending from the opening 145 to the opening 149 along the lower wall 105; and the upper ink chamber 52 continuous with the lower ink chamber 51 in a vicinity of the opening 149 and extending upwardly from the opening 149 along the rear wall 110. The liquid surface of ink when the maximum pemissible amount of ink is stored in the first ink chamber 131 and the second ink chamber 132, in the ink tank 100 in the usable posture, is at the same height as the first line 146 (broken line 191).

As ink is discharged from the recording head 39, ink stored in the second ink chamber 132 flows into the ink tube 32 via the ink outflow passage 114 and the opening 158 of the protrusion 157. When ink of the second ink chamber 132 flows out to the ink tube 32, ink flows from the first ink chamber 131 into the second ink chamber 132 via the opening 145. As a result, the liquid surface of ink in the first ink chamber 131 and the liquid surface of ink in the second ink chamber 132 attain substantially the same height.

When the liquid surface of ink attains the same height as the second line 147 (broken line 195), it becomes necessary to replenish the ink tank 100 with ink. In other words, the second line 147 indicates the height of the liquid surface of ink when replenishment of the ink tank 100 with ink becomes necessary, in the ink tank 100 in the usable posture. The ink amount when replenishment of the ink tank 100 with ink becomes necessary is an example of a minimum storage amount. Generally, the ink tank 100 is used in a state where the liquid surface of ink is between the first line 146 and the second line 147. In other words, the ink tank 100 is used in a state where at least the minimum storage amount of ink is stored therein.

For example, when a large amount of ink is sucked up from the nozzle 40 in maintenance of the recording head 39, or when photograph printing in which a discharge amount of ink droplets is comparatively large is performed, and so on, a large amount of ink flows out from the second ink chamber 132 of the ink tank 100 to the ink tube 32.

When the liquid surfaces of ink in the first ink chamber 131 and the second ink chamber 132 are at the same height as the second line 147, a value of a first pressure loss R1 when ink flows from the opening 145 to the opening 149 via the lower ink chamber 51 is equal to a value of a second pressure loss R2 when ink of the upper ink chamber 52 flows to the opening 149. Moreover, the value of the first pressure loss R1 and the value of the second pressure loss R2 are smaller than a value of pressure loss when ink flows from the opening 149 to the recording head 39 via the buffer chamber 148, the ink outflow passage 114, and the ink tube 32, specifically, the value of the first pressure loss R1 and the value of the second pressure loss R2 are substantially equal to zero. In other words, the value of the first pressure loss R1 and the value of the second pressure loss R2 are extremely small values, to an extent that they could be said to be substantially zero, compared to the value of pressure loss when ink flows from the opening 149 to the recording head 39 via the buffer chamber 148, the ink outflow passage 114, and the ink tube 32. Therefore, "the value of the first pressure loss R1 and the value of the second pressure loss R2 are equal" means that the value of the first pressure loss R1 and the value of the second pressure loss R2, even supposing that they are not equal when strictly measured, are extremely small, to an extent that they could be said to be substantially zero, compared to the value of pressure loss when ink flows from the opening 149 to the recording head 39 via the buffer chamber 148, the ink outflow passage 114, and the ink tube 32, hence are substantively equal. As a result, in the ink tank 100 in the usable posture, when ink is stored such that the liquid surface of ink becomes higher than the second line 147, in the second ink chamber 132, a flow speed of ink in the upper ink chamber 52 and a flow speed of ink flowing from the first ink chamber 131 to the opening 149 become substantively equal. Hence, an outflow speed of ink in the first ink chamber 131 and an outflow speed of ink in the second ink chamber 132 become substantively equal.

[Function and Effect of Embodiment]

Due to the ink tank 100 according to the present embodiment, outflow speeds of ink in each of the first ink chamber 131 and the second ink chamber 132 easily become uniform. As a result, it is suppressed that the liquid surface of ink in the upper ink chamber 52 of the second ink chamber 132 falls more rapidly compared to the liquid surface of ink in the first ink chamber 131, even when ink has been consumed in large quantity in the recording head 39, and it is suppressed that regardless of sufficient ink being stored in the first ink chamber 131, a bubble, or the like, enters the opening 149 from the second ink chamber 132.

Moreover, a detection position of the optical sensor 98 in the protrusion 167 is set downwardly of the second line 147. Therefore, after the user has visually confirmed via the upright wall 102 that the liquid surface of ink in the first ink chamber 131 substantially matches the second line 147, a high level signal is outputted from the optical sensor 98. Note that the detection position of the optical sensor 98 in the protrusion 167 may be set to a height equal to that of the second line 147. In this case, it is possible for a timing at which the user visually confirms via the upright wall 102 that the liquid surface of ink in the first ink chamber 131 substantially matches the second line 147, and a timing at which the optical sensor 98 outputs the high level signal, to be matched.

Moreover, in the ink tank 100 in the usable posture, the first length L1 of the first ink chamber 131 is longer than the second length L2 of the second ink chamber 132. Therefore, when the ink tank 100 has been inclined such that the liquid surface of ink intersects the horizontal direction, that is, such that the front end of the lower wall 105 of the ink tank 100 becomes higher or lower than its rear end, a relative movement distance with respect to an inner wall surface of the second ink chamber 132, of an edge of the liquid surface of ink in the second ink chamber 132 becomes smaller than a relative movement distance with respect to an inner wall surface of the first ink chamber 131, of an edge of the liquid surface of ink in the first ink chamber 131. For example, when the ink tank 100 is inclined such that the front end of the lower wall 105 of the ink tank 100 becomes higher than its rear end, the liquid surface of ink moves relatively upwardly with respect to the inner wall surface at the rear. At this time, the movement distance of the edge of the liquid surface of the second ink chamber 132 is smaller than the movement distance of the edge of the liquid surface of the first ink chamber 131. As a result, stable residual amount detection of ink in the second ink chamber 132 can be achieved.

[Modified Embodiments]

In the above-described embodiment, a part of the first ink chamber 131 is demarcated by the left wall 103 acting as a side wall. However, the side wall demarcating the first ink chamber 131 need not necessarily be a wall configured by the frame 141, and the films 142, 143 may demarcate a part of the first ink chamber 131 as a side wall.

Moreover, in the above-described embodiment, one inlet 112 was provided in each of the ink tanks 100. However, two or more inlets 112 may be provided in each of the ink tanks 100.

Moreover, in the above-described embodiment, one air opening port 187 was provided in each of the ink tanks 100. However, two or more air opening ports 187 may be provided in each of the ink tanks 100.

Moreover, in the above-described embodiment, one opening 158 out of which ink in the ink chamber 111 flows was provided in each of the ink tanks 100. However, two or more openings 158 may be provided in each of the ink tanks 100.

Moreover, in the above-described embodiment, the second ink chamber 132 included the buffer chamber 148 and the ink outflow passage 114. However, the first ink chamber 131 may include the buffer chamber 148 and the ink outflow passage 114. In this case, the buffer chamber 148 interposes between the first ink chamber 131 and the ink outflow passage 114. In addition, both of the first ink chamber 131 and the second ink chamber 132 may include the buffer chamber 148 and the ink outflow passage 114.

Moreover, in the above-described embodiment, ink was described as an example of the liquid. However, the present embodiment is not limited to this. That is, instead of ink, the likes of a pretreatment liquid discharged onto a recording sheet prior to the ink during printing, or water sprayed in a vicinity of the nozzle 40 of the recording head 39 for preventing drying of the nozzle 40 of the recording head 39, may be examples of the liquid.

What is claimed is:

1. A tank configured to be installed in a liquid consuming apparatus having a liquid consuming unit and be connected to the liquid consuming unit such that liquid flows between the tank and the liquid consuming unit, the tank comprising:

a casing having a bottom wall, a rear wall, and a side wall in a usable posture of the tank, the side wall extending in a direction intersecting with the bottom wall, the rear wall extending in a direction intersecting the bottom wall and the side wall;

a storage chamber provided in the casing and configured to store the liquid; and a communication port provided in the storage chamber to let the liquid flow out to an outside of the tank from an opening through the rear wall, wherein the storage chamber includes:

a first space extending along the bottom wall from the communication port; and a second space connected to the first space in a vicinity of the communication port and extending along the side wall and the rear wall from the communication port, and in a state that the liquid is stored at least in the first space and the second space, a first pressure loss when the liquid stored in the storage chamber flows to the communication port via the first space is equal to a second pressure loss when the liquid stored in the storage chamber flows to the communication port along the second space.

2. The tank according to claim 1, wherein the casing comprises an inlet through which the liquid is injected into the storage chamber.

3. The tank according to claim 1, wherein the first pressure loss and the second pressure loss are less than a pressure loss from the communication port to the liquid consuming unit.

4. The tank according to claim 1, wherein at least a portion of the frame demarcating the storage chamber has translucency such that a liquid surface of the liquid stored in the storage chamber can be visually confirmed.

5. A liquid consuming apparatus comprising:

the tank as defined in claim 1;

the liquid consuming unit; and a tube connecting the tank and the liquid consuming unit.

* * * * *